US010190227B2

(12) United States Patent
Ruan et al.

(10) Patent No.: US 10,190,227 B2
(45) Date of Patent: Jan. 29, 2019

(54) ARTICLES COMPRISING AN ELECTRODEPOSITED ALUMINUM ALLOYS

(71) Applicant: Xtalic Corporation, Marlborough, MA (US)

(72) Inventors: Shiyun Ruan, Arlington, MA (US); Witold Paw, Sandy Hook, CT (US); John Hunter Martin, Los Angeles, CA (US); Alan C. Lund, Ashland, MA (US)

(73) Assignee: Xtalic Corporation, Marlborough, MA (US)

( * ) Notice: Subject to any disclaimer, the term of this patent is extended or adjusted under 35 U.S.C. 154(b) by 0 days.

(21) Appl. No.: 13/830,531

(22) Filed: Mar. 14, 2013

(65) Prior Publication Data

US 2014/0272458 A1 Sep. 18, 2014

(51) Int. Cl.
*C25D 3/44* (2006.01)
*B32B 15/20* (2006.01)
(Continued)

(52) U.S. Cl.
CPC ..... *C25D 3/44* (2013.01); *C22C 21/00* (2013.01); *C22C 22/00* (2013.01); *C23C 30/00* (2013.01);
(Continued)

(58) Field of Classification Search
CPC ... B32B 15/012; B32B 15/016; B32B 15/017; B32B 15/20; C22C 21/00; C22C 22/00; C23C 26/00; C23C 30/00; C23C 30/005; Y10T 428/12; Y10T 428/12736; Y10T 428/12431; Y10T 428/12438; Y10T 428/12743; Y10T 428/1275; Y10T 428/12757; Y10T 428/12764; Y10T 428/26; Y10T 428/263; Y10T 428/264; Y10T 428/265
(Continued)

(56) References Cited

U.S. PATENT DOCUMENTS 9,752,242 B2 9/2017 Abbott et al.
2010/0285322 A1 11/2010 Inoue et al.
(Continued)

FOREIGN PATENT DOCUMENTS

CN 101555608 A 10/2009
CN 101760758 A 6/2010
(Continued)

OTHER PUBLICATIONS

Matsui et al., Fabrication of bulk nanocrystalline Al electrodeposited from a dimethylsulfone bath. Mater Sci Eng A. 2012;550:363-6.
(Continued)

*Primary Examiner* — Michael E. La Villa
(74) *Attorney, Agent, or Firm* — Wolf, Greenfield & Sacks, P.C.

(57) ABSTRACT

An article comprising an electrodeposited aluminum alloy is described herein. The electrodeposited aluminum alloy comprises an average grain size less than approximately 1 micrometer. The electrodeposited aluminum alloy thickness is greater than approximately 40 micrometers. A ductility of the electrodeposited aluminum alloy is greater than approximately 2%.

24 Claims, 18 Drawing Sheets

(51) Int. Cl.

| | |
|---|---|
| ***C25D 1/00*** | (2006.01) |
| ***C23C 30/00*** | (2006.01) |
| ***C22C 22/00*** | (2006.01) |
| ***C22C 21/00*** | (2006.01) |
| ***C25D 3/66*** | (2006.01) |
| ***C25D 1/02*** | (2006.01) |
| ***C25D 1/04*** | (2006.01) |
| ***C25D 3/56*** | (2006.01) |
| *C25D 11/04* | (2006.01) |

(52) U.S. Cl.
CPC ..... *C23C 30/005* (2013.01); *C25D 1/02* (2013.01); *C25D 1/04* (2013.01); *C25D 3/56* (2013.01); *C25D 3/665* (2013.01); *C25D 11/04* (2013.01); *Y10T 428/12* (2015.01); *Y10T 428/1275* (2015.01); *Y10T 428/12431* (2015.01); *Y10T 428/12438* (2015.01); *Y10T 428/12736* (2015.01); *Y10T 428/12743* (2015.01); *Y10T 428/12757* (2015.01); *Y10T 428/12764* (2015.01); *Y10T 428/26* (2015.01); *Y10T 428/263* (2015.01); *Y10T 428/264* (2015.01); *Y10T 428/265* (2015.01)

(58) Field of Classification Search
USPC ..... 428/650, 544, 606, 607, 651, 652, 653, 428/654, 332, 334, 335, 336; 420/528
See application file for complete search history.

(56) References Cited

U.S. PATENT DOCUMENTS

| | | | | |
|---|---|---|---|---|
| 2011/0014488 | A1* | 1/2011 | Palumbo et al. ..... | 428/548 |
| 2011/0083967 | A1 | 4/2011 | Ruan et al. | |
| 2012/0006688 | A1 | 1/2012 | Alemany et al. | |
| 2012/0031766 | A1 | 2/2012 | Inoue et al. | |
| 2012/0052324 | A1 | 3/2012 | Inoue et al. | |
| 2012/0118745 | A1 | 5/2012 | Bao | |
| 2016/0076161 | A1 | 3/2016 | Abbott et al. | |
| 2017/0009360 | A1 | 1/2017 | Schuh et al. | |
| 2018/0171498 | A1 | 6/2018 | Abbott et al. | |

FOREIGN PATENT DOCUMENTS

| | | |
|---|---|---|
| CN | 101781785 A | 7/2010 |
| CN | 102337570 A | 2/2012 |
| WO | PCT/US2014/021947 | 8/2014 |
| WO | PCT/US2014/021947 | 9/2015 |

OTHER PUBLICATIONS

Ruan et al., Towards electroformed nanostructured aluminum alloys with high strength and ductility. J Mater Res. 2012;27(12):1638-51. 14 pages.

Schuh et al., Electrodeposited Al—Mn alloys with microcrystalline, nanocrystalline, amorphous and nano-quasicrystalline structures. Acta Mater. 2009;57:3810-22.

Schuh et al., Tuning nanoscale grain size distribution in multilayered Al—Mn alloys. Scripta Mater. 2012;66:194-7.

International Search Report and Written Opinion dated Aug. 19, 2014 for Application No. PCT/US2014/021947.

International Preliminary Report on Patentability dated Sep. 24, 2015 for Application No. PCT/US2014/021947.

U.S. Appl. No. 15/691,893, filed Aug. 31, 2017, Abbott et al.

U.S. Appl. No. 14/489,107, filed Sep. 17, 2014, Abbott et al.

U.S. Appl. No. 15/093,837, filed Apr. 8, 2016, Schuh et al.

* cited by examiner

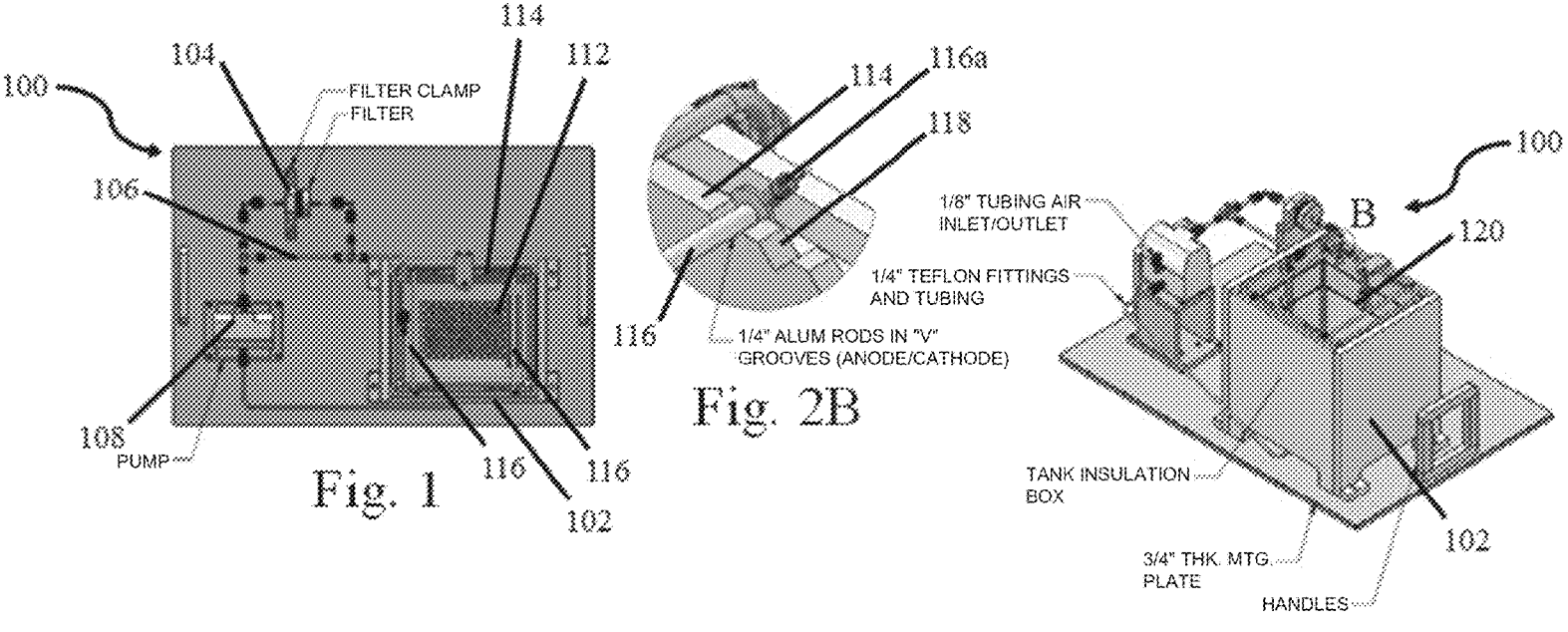
Fig. 1
Fig. 2B
Fig. 2
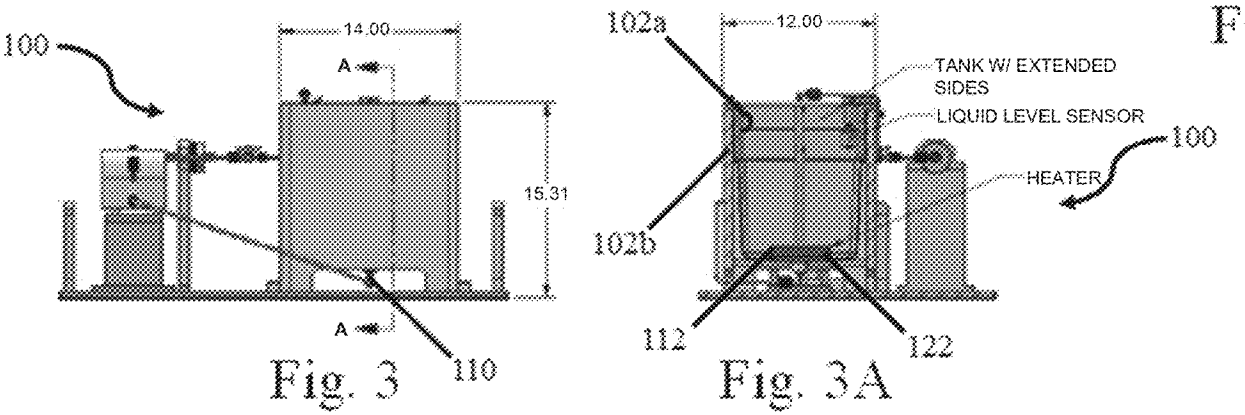
Fig. 3
Fig. 3A

| | Forward Pulse Current Density (mA/cm^2) | Forward Pulse Duration (ms) | Reverse Pulse Current Density (mA/cm^2) | Reverse Pulse Duration (ms) | Waveform Description | Plating Rate (μm/hr) | Mn (at%) | Bend Test Measured Ductility |
|---|---|---|---|---|---|---|---|---|
| A1 | 240 | 20 | 120 | 20 | Initial waveforms | 81 | 7.8 | ~12% |
| A2 | 300 | 20 | 150 | 20 | | 101 | 7.6 | >12% |
| A3 | 360 | 20 | 180 | 20 | | 121 | 7.4 | >12% |
| A4 | 240 | 40 | 120 | 40 | as above but doubled pulse times | 81 | 7.4 | <12% |
| A5 | 300 | 40 | 150 | 40 | | 101 | 7.4 | <12% |
| A6 | 360 | 40 | 180 | 40 | | 121 | 7.1 | <12% |
| A7 | 180 | 30 | 180 | 15 | equal pulse amplitude, long forward time | 81 | 8.3 | >12% |
| A8 | 225 | 30 | 225 | 15 | | 101 | 7.7 | >12% |
| A9 | 270 | 30 | 270 | 15 | | 121 | 7.9 | >12% |
| A10 | 180 | 60 | 180 | 30 | as above with doubled pulse times | 81 | 7.2 | <12% |
| A11 | 225 | 60 | 225 | 30 | | 101 | 7.4 | <12% |
| A12 | 270 | 60 | 270 | 30 | | 121 | 7.0 | <12% |
| A13 | 160 | 60 | 240 | 20 | stronger reverse pulse, longer forward time | 81 | 7.9 | <12% |
| A14 | 200 | 60 | 300 | 20 | | 101 | 7.5 | <12% |
| A15 | 240 | 60 | 360 | 20 | | 121 | 7.7 | <12% |

Fig. 19

ARTICLES COMPRISING AN ELECTRODEPOSITED ALUMINUM ALLOYS

FIELD OF THE INVENTION

Embodiments of the current disclosure are related to electrodeposition in ionic liquid electrolytes.

BACKGROUND

Electrodeposited stable nano structured aluminum manganese alloys exhibit an exceptional combination of high hardness and tensile ductility. In addition to the combination of high hardness and tensile ductility, the alloys are approximately the same density as other aluminum alloys. This combination of high strength, ductility, and light weight make it an ideal structural material for applications such as armor, aircraft, sporting equipment, and other applications where a light weight high strength ductile material would be of benefit.

SUMMARY

In one embodiment, an electrodeposition bath for depositing an aluminum alloy may include: aluminum ionic species; a second type of metal ionic species; an ionic liquid; and an additive having the formula $[R^3SO_4]^-[M^+]$. $R^3$ may be optionally substituted alkyl, optionally substituted aryl, or optionally substituted heteroalkyl. $M^+$ may be $Na^+$ or $K^+$.

In another embodiment, an electrodeposition bath for depositing an aluminum alloy may include: aluminum ionic species; a second type of metal ionic species; an ionic liquid; and an additive having the formula $[R^4N(R^5)_3]^+[Z^-]$. $R^4$ and each $R^5$ may independently be hydrogen, optionally substituted alkyl, optionally substituted aryl, or optionally substituted heteroalkyl. $Z^-$ may be an anion.

In yet another embodiment, an electrodeposition bath for depositing aluminum or an aluminum alloy may include: aluminum ionic species; an ionic liquid; and an additive having the formula:

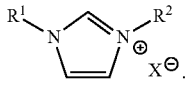

$R^1$ may be optionally substituted $C_1$-$C_{30}$ alkyl. $R^2$ may be optionally substituted $C_8$-$C_{30}$ alkyl. $X^-$ may be an anion.

In another embodiment, an electrodeposition bath for depositing aluminum or an aluminum alloy may include: aluminum ionic species; an ionic liquid; and an additive comprising a polystyrene and/or a styrenic copolymer.

In yet another embodiment, a method of depositing an aluminum alloy may include: providing an anode, a cathode, an electrodeposition bath associated with the anode and the cathode, and a power supply connected to the anode and the cathode; and driving the power supply to electrodeposit an aluminum alloy on the cathode. The electrodeposition bath may include: aluminum ionic species; a second type of metal ionic species; an ionic liquid; and an additive having the formula $[R^3SO_4]^-[M^+]$. $R^3$ may be optionally substituted alkyl, optionally substituted aryl, or optionally substituted heteroalkyl. $M^+$ may be $Na^+$ or $K^+$.

In another embodiment, a method of depositing an aluminum alloy may include: providing an anode, a cathode, an electrodeposition bath associated with the anode and the cathode, and a power supply connected to the anode and the cathode; and driving the power supply to electrodeposit an aluminum alloy on the cathode. The electrodeposition bath may include: aluminum ionic species; a second type of metal ionic species; an ionic liquid; and an additive having the formula $[R^4N(R^5)_3]^+[Z^-]$. $R^4$ and each $R^5$ may independently be hydrogen, optionally substituted alkyl, optionally substituted aryl, or optionally substituted heteroalkyl. $Z^-$ may be an anion.

In yet another embodiment, a method of depositing aluminum or an aluminum alloy may include: providing an anode, a cathode, an electrodeposition bath associated with the anode and the cathode, and a power supply connected to the anode and the cathode; and driving the power supply to electrodeposit aluminum or an aluminum alloy on the cathode. The electrodeposition bath may include: aluminum ionic species; an ionic liquid; and an additive having the formula:

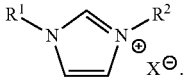

$R^1$ may be optionally substituted $C_1$-$C_{30}$ alkyl. $R^2$ may be optionally substituted $C_8$-$C_{30}$ alkyl. $X^-$ may be an anion.

In another embodiment, a method of depositing aluminum or an aluminum alloy may include: providing an anode, a cathode, an electrodeposition bath associated with the anode and the cathode, and a power supply connected to the anode and the cathode; and driving the power supply to electrodeposit an aluminum alloy on the cathode. The electrodeposition bath may include: aluminum ionic species; an ionic liquid; and an additive comprising a polystyrene and/or a styrenic copolymer.

In yet another embodiment, a method of analyzing a metal ionic species in a metal alloy electrodeposition bath may include: providing an electrodeposition bath comprising aluminum chloride, a second type of metal ionic species, and an ionic liquid; removing a sample from the electrodeposition bath; adding a solution comprising alcohol to the sample, followed by the addition of water to form a test solution, wherein the test solution is homogeneous; and analyzing the test solution to determine the concentration of aluminum ionic species and/or the second type of metal ionic species in the electrodeposition bath.

In another embodiment, a method of analyzing an additive in an aluminum alloy electrodeposition bath may include: providing an electrodeposition bath comprising aluminum ionic species, a second type of metal ionic species, an ionic liquid, and at least one type of additive; plating an aluminum alloy on a rotating disk electrode; and determining the concentration of at least one additive based at least in part on visual observation and/or instrumented measurement of the plated aluminum alloy.

In yet another embodiment, a method of replenishing a metal ionic species in an alloy electrodeposition bath may include: providing an electrodeposition bath comprising a first type of metal ionic species, a second type of metal ionic species, and an ionic liquid; forming a saturated solution of the second type of metal ionic species, wherein the saturated solution comprises an ionic liquid; and adding a portion of the saturated solution to the electrodeposition bath to increase the concentration of the metal ionic species in the electrodeposition bath.

In another embodiment, an electrodeposition system may include an electrodeposition bath comprising an ionic liquid, an anode located in the electrodeposition bath, and an anode bag comprising a material that is substantially compatible with the ionic liquid. The anode may be disposed in the anode bag.

In yet another embodiment, a method for electrodepositing a metal may include: providing an electrodeposition bath comprising an ionic liquid; electrodepositing a metal onto a substrate located in the electrodeposition bath; filtering the electrodeposition bath to remove contaminants from the electrodeposition bath.

In another embodiment, a method for electrodepositing a metal in an ionic liquid may include: providing an electrodeposition bath comprising an ionic liquid; providing a substrate; shielding a portion of the substrate with a material compatible with the ionic liquid; placing the substrate into the electrodeposition bath; and electrodepositing a metal onto an uncovered portion of the substrate, wherein the metal is at least partially prevented from being deposited on the shielded portion of the substrate.

In yet another embodiment, a method for electrodepositing a metal in an ionic liquid electrolyte may include: providing an electrodeposition bath comprising an ionic liquid; providing a blanket layer on top of the electrodeposition bath to separate the electrodeposition bath from the surrounding environment, wherein the blanket layer is at least partially immiscible with the ionic liquid; and electrodepositing a metal onto a substrate located in the electrodeposition bath.

In another embodiment, a method for electrodepositing a metal in an ionic liquid electrolyte may include: providing an electrodeposition bath comprising an ionic liquid; providing a substrate located in the electrodeposition bath; flowing the electrodeposition bath in a first direction across the substrate, wherein a first velocity of the flowing electrodeposition bath in the first direction is approximately between 0.001 m/s and 100 m/s; moving the substrate in a second direction, wherein at least a component of the second direction is orthogonal to the first direction, wherein a second velocity of the substrate in the second direction is approximately between 0.001 m/s and 100 m/s; and electrodepositing a metal onto the substrate located in the electrodeposition bath.

In yet another embodiment, a method for electrodepositing an aluminum alloy may include: providing an electrodeposition bath comprising an ionic liquid; providing a substrate located in the electrodeposition bath; and electrodepositing a metal onto the substrate at a rate between approximately 10 micrometers per hour to approximately 1000 micrometers per hour, wherein an average grain size of the electrodeposited aluminum alloy is less than approximately 1 micron.

In another embodiment, an article may include an electrodeposited aluminum alloy. The electrodeposited aluminum alloy may have an average grain size less than approximately 1 micrometer. The electrodeposited aluminum alloy may have a thickness greater than approximately 40 micrometers. A ductility of the electrodeposited aluminum alloy may also be greater than approximately 2%.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 1 is a schematic top view of an electrodeposition system for use with an ionic liquid electrolyte;

FIG. 2 is a schematic perspective view of the electrodeposition system of FIG. 1;

FIG. 2B is an enlarged schematic perspective view of the electrode rack of the electrodeposition system of FIG. 2;

FIG. 3 is a schematic side view of the electrodeposition system of FIG. 1;

FIG. 3A is a cross-sectional view of the electrodeposition system of FIG. 3;

FIG. 19 is a chart comparing the bending performance of materials deposited with different electrodeposition waveform parameters.

DETAILED DESCRIPTION

Figure 8:
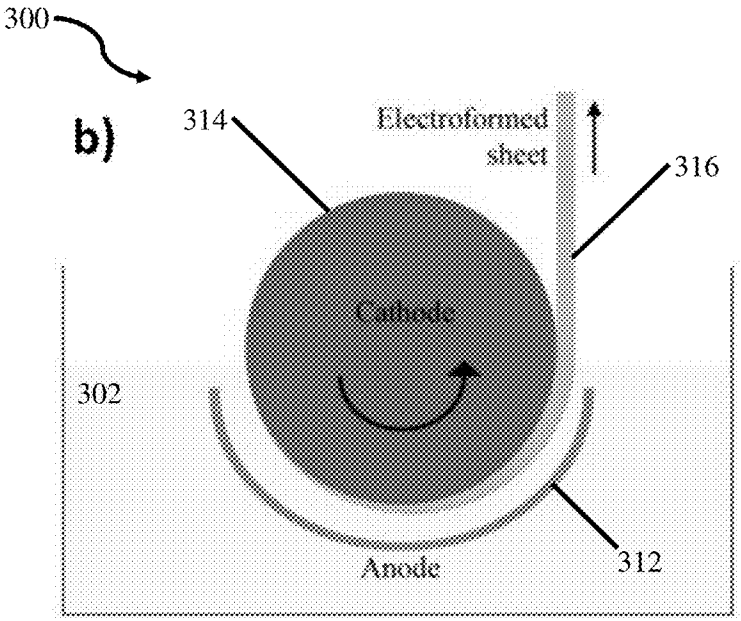
FIG. 8 is a schematic representation of a continuous sheet electroforming process.
Figure 7:
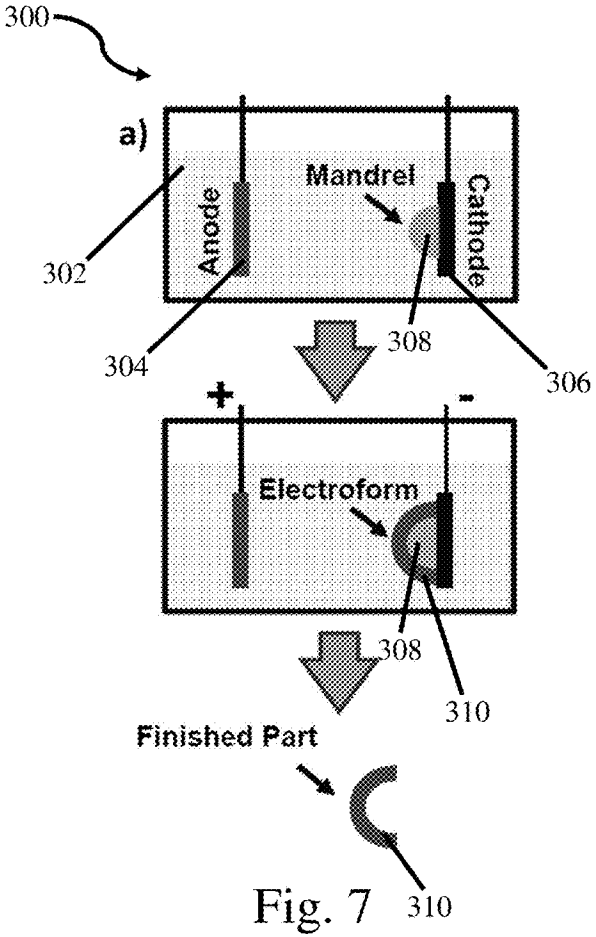
FIG. 7 is a schematic representation of a net shape electroforming process.

The inventors have recognized that the manufacture of coatings and net shaped parts comprising the above noted nano structured aluminum manganese alloys in thick sections and at high deposition rates is desirable. However, when current chemistries and methods are used with electrolyte baths including ionic liquids at higher deposition rates; runaway dendritic growth may occur and/or electrodeposited layers and net shaped parts lack structural integrity. These limitations associated with ionic liquid based systems have prevented the use of these materials on an industrial scale to form electrodeposited coatings, electroformed net shaped parts 310 as depicted in FIG. 7, electroformed sheets as depicted in FIG. 8, and other relevant structures and components. Further, the inventors have recognized industrially relevant applications for these and other alloys electrodeposited in electrolyte baths containing ionic liquids for bulk alloys, corrosion resistant coatings, wear resistant coatings, catalysts, batteries, aerospace applications, automotive applications, and military applications. Therefore, the inventors have recognized the need to develop processes, methods, and chemistries to enable electrodeposition of materials within electrolyte baths containing ionic liquids on an industrially relevant scale.

The inventors have recognized that the lack of effective surface leveler additives for ionic liquids to suppress dendritic growth has hampered the development of high rate deposition methods. Furthermore, given the differences between the current electrolyte baths incorporating ionic liquids and previous aqueous based electrolytes, it is not clear that additives and methods used for aqueous based electrolyte electrodeposition systems are capable of working in ionic liquid based electrodeposition systems. Additionally, ionic liquids are highly corrosive making them unsuitable for use with many of the systems and components used in large-scale aqueous based electrodeposition systems. Consequently, ionic liquid based electrodeposition systems have been limited to small laboratory scale reactors depositing thin coatings at relatively low rates. In view of the above, the inventors have developed and identified methods, materials, additives, and analytical techniques for use with ionic liquid based electrolytes. These methods, materials, additives, and analytical techniques enable the deposition of coatings and thick monolithic structures possessing the structural properties of the previously formed thin films at high deposition rates while delaying the onset of dendritic growth and maintaining the ionic liquid based electrolyte bath within predefined operating limits.

In some embodiments, electrodeposition baths for depositing aluminum, or an aluminum alloy, and/or related methods are provided, wherein the electrodeposition bath comprising aluminum ionic species, optionally a second type of metal ionic species, an ionic liquid, and at least one type of additive. In some embodiments, the electrodeposition bath comprises an organic co-solvent. The organic co-solvent (also referred to herein as a cosolvent) may be used to reduce the viscosity of the ionic liquid electrolyte, improve the conductivity of the ionic liquid electrolyte, improve electrodeposition rates, improve the deposit appearance, and/or reduce dendritic growth.

In addition to the above, specific reactor designs, process control methods, and materials for use with electrodeposition systems using ionic liquid electrolytes are disclosed. Materials compatible with the corrosive ionic liquid based electrolyte baths, and the additives and salts contained therein, may include, but are not limited to, polytetrafluoroethylene, perfluoroalkoxy, fluorinated ethylene propylene, glass, alumina, quartz, silicon carbide, stainless steel, titanium alloys, para-aramid polymers, thiolene, nickel alloys (e.g. nickel-chromium-iron alloys and nickel superalloys), zirconium alloys, and refractory metals. Thus, these materials may be used to construct the various components in the reactor. The electrodeposition system may also include manual and/or automatic maintenance procedures to maintain the electrolyte bath, including maintaining cosolvent concentrations as well as additive and metal ionic species concentrations. The maintenance procedures may include, but are not limited to, electrolyte filtration, cosolvent additions, additive replenisher additions, and alloying element replenisher additions to maintain the electrolyte bath within preselected operating parameters during electrodeposition. Maintenance procedures may be executed according to a predetermined known consumption rate, or they may be executed upon monitors sensing an operating parameter falling above, or below, a preselected threshold.

As described in more detail below, the disclosed additives, cosolvents, reactor designs, process control methods, and analytical methods may be combined to enable electrodeposition of monolithic coatings and parts at deposition rates ranging from between approximately 10 μm/hr to approximately 1000 μm/hr and thicknesses ranging from between thin coatings approximately 0.1 μm thick to structural members approximately 10 cm thick, or any other appropriate thickness.

While the current disclosure focuses on chemistries, methods, and systems for use with aluminum manganese based alloys, it should be understood that the current disclosure should be interpreted as generally teaching chemistries, methods and systems for use with ionic liquid electrolytes. For example, the current disclosure is applicable to the electrodeposition of any metal based system in an ionic liquid electrolyte including, for example, titanium based alloys, nickel based alloys, copper based alloys, gold alloys, refractory metal alloys, as well as pure metals. However, for the sake of clarity the current disclosure describes the present chemistries, systems, and methods with respect to the deposition of an aluminum manganese alloy. In addition, for the sake of clarity, the work piece, i.e. the component experiencing a net gain of material during the deposition process, will be referred to as the cathode and the component experiencing a net loss of material during the deposition process will be referred to as the anode(s) for purposes of this application. Consequently, even when reverse pulses are applied, as described herein, the workpiece would still be referred to as the cathode. However, this is not meant to limit the way in which any appropriate electrodeposition waveform might be applied to the components during the electrodeposition process. For example, forward pulses, reverse pulses, pauses, and other appropriate electrodeposition processes may be applied to the work piece as described in more detail below.

Ionic Liquid Electrolyte Chemistries

In some embodiments, electrodeposition baths for depositing aluminum or an aluminum alloy are provided comprising aluminum ionic species, optionally a second type of metal ionic species, an ionic liquid, an organic co-solvent, and at least one type of additive. In some embodiments, methods for depositing aluminum or an aluminum alloy are provided comprising providing an anode, a cathode, an electrodeposition bath associated with the anode and the cathode, and a power supply connected to the anode and the cathode; and driving the power supply to electrodeposit an aluminum alloy on the cathode, wherein the electrodeposition bath comprises aluminum ionic species, optionally a second type of metal ionic species, an ionic liquid, an organic co-solvent, and at least one additive. In some embodiments, more than one type of additive is provided, for example, two types, three types, or four types of additives are provided. In some cases, the additive(s) reduces or eliminates the formation of dendrites.

In some embodiments, an electrodeposition bath for depositing aluminum or an aluminum alloy comprises aluminum ionic species, an ionic liquid, an organic co-solvent, and an additive having the formula:

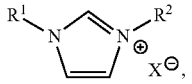

wherein $R^1$ is optionally substituted $C_1$-$C_{30}$ alkyl, $R^2$ is optionally substituted $C_8$-$C_{30}$ alkyl, and $X^-$ is an anion. In cases where the bath is to be used for depositing an aluminum alloy, the bath additionally comprises at least a second type of metal ionic species. Various components of the bath are described herein (e.g., aluminum ionic species, second type of metal ionic species, ionic liquids, organic co-solvents). The additive may be present in any suitable amount, for example, in an amount between about 0.01 and about 50 wt %, between about 0.1 and about 50 wt %, between 1 and about 50 wt %, between 1 and about 40 wt %, between 1 and about 30 wt %, between 1 and about 20 wt %, between 1 and about 10 wt %, between 5 and about 50 wt %, between 10 and about 50 wt %, between 20 and about 50 wt %, between 30 and about 50 wt %, about 0.01 wt %, about 0.1 wt %, about 1 wt %, about 5 wt %, about 10 wt %, about 20 wt %, about 30 wt %, about 40 wt %, or about 50 wt %, versus the total bath composition. Non-limiting examples of $C_1$-$C_{30}$ alkyl groups include methyl, ethyl, propyl, butyl, pentyl, hexyl, octyl, nonyl, decyl, undecyl, dodecyl, tridecyl, tetradecyl, pentadecyl, hexadecyl, heptadecyl, octadecyl, nonadecyl, eicosyl, and isomers thereof (ie., including cyclic groups such as cyclopropyl, cyclobutyl, cyclopentyl, cyclohexyl, etc.). Non-limiting examples of $C_8$-$C_{30}$ groups include octyl, nonyl, decyl, undecyl, dodecyl, tridecyl, tetradecyl, pentadecyl, hexadecyl, heptadecyl, octadecyl, nonadecyl, eicosyl, and isomers thereof (ie., including cyclic groups). In some embodiments, $R^2$ is optionally substituted $C_{13}$-$C_{30}$ alkyl or unsubstituted $C_{13}$-$C_{30}$ alkyl. In some embodiments, $R^2$ is optionally substituted $C_{16}$-$C_{30}$ alkyl or unsubstituted $C_{16}$-$C_{30}$ alkyl. In some embodiments, $R^1$ is optionally substituted $C_1$-$C_{16}$ alkyl or unsubstituted $C_1$-$C_{16}$ alkyl. In some embodiments, $R^1$ is optionally substituted $C_1$-$C_{12}$ alkyl or unsubstituted $C_1$-$C_{12}$ alkyl. In some embodiments, $R^1$ is optionally substituted $C_1$-$C_8$ alkyl or unsubstituted $C_1$-$C_8$ alkyl. In some embodiments, $R^2$ is hexadecyl. In some embodiments, the additive is 1-hexadecyl-3-methylimidazolium halide. In some embodiments, the additive is 1-hexadecyl-3-methylimidazolium chloride.

$X^-$ may be any suitable anion. Non-limiting examples of anions include halide, nitrate, nitrite, carbonate, phosphite, phosphate, sulphite, sulphate, and triflate. In some embodiments, $X^-$ is a halide. In some embodiments, $X^-$ is chloride. In some embodiments, the anion of the additive and the counter anion of the aluminum ionic species are the same. In some embodiments, the anion of the additive, the counter anion of aluminum ionic species, and the counter anion of the second type of metal ionic species are the same. In some embodiments, $X^-$ is chloride.

In some embodiments, an electrodeposition bath for depositing an aluminum alloy comprises aluminum ionic species, a second type of metal ionic species, an ionic liquid, an organic co-solvent, an additive having the formula $[R^3SO_4]^-[M^+]$, wherein $R^3$ is optionally substituted alkyl, optionally substituted aryl, or optionally substituted heteroalkyl, and $M^+$ is a metal. Various components of the bath are described herein (e.g., aluminum ionic species, second type of metal ionic species, ionic liquids, organic co-solvents). In some embodiments, $M^+$ is $Na^+$ or $K^+$. In some embodiments, $M^+$ is $Na^+$. In some embodiments, $R^3$ is $C_1$-$C_{30}$ alkyl, or $C_1$-$C_{20}$ alkyl, or $C_1$-$C_{15}$ alkyl, each optionally substituted. In some embodiments, $R^3$ is aryl, optionally substituted. In some embodiments $R^3$ is phenyl, optionally substituted. In some embodiments, $[R^3SO_4]^-[M^+]$ is sodium dodecyl sulfate. The additive $[R^3SO_4]^-[M^+]$ may be present in any suitable amount, for example, in an amount between about 0.001 and about 10 wt %, between about 0.01 and about 10 wt %, between about 0.1 and about 9 wt %, between about 0.1 and about 8 wt %, between about 0.1 and about 7 wt %, between about 0.1 and about 6 wt %, between about 0.1 and about 5 wt %, between about 0.1 and about 4 wt %, between about 0.1 and about 3 wt %, between about 1 and about 10 wt %, between about 2 and about 10 wt %, between about 3 and about 10 wt %, between about 4 and about 10 wt %, between about 5 and about 10 wt %, about 0.001, about 0.05 wt %, about 0.1 wt %, about 0.5 wt %, about 1 wt %, about 2 wt %, about 3 wt %, about 4 wt %, about 5 wt %, about 6 wt %, about 7 wt %, about 8 wt %, about 9 wt %, or about 10 wt %, versus the total bath composition.

In some embodiments, an electrodeposition bath for depositing an aluminum alloy comprises aluminum ionic species, a second type of metal ionic species, an ionic liquid, an organic co-solvent; an additive having the formula $[R^4N(R^5)_3]^+[Z^-]$, wherein $R^4$ and each $R^5$ is independently hydrogen, optionally substituted alkyl, optionally substituted aryl, or optionally substituted heteroalkyl, and $Z^-$ is an anion. Various components of the bath are described herein (e.g., aluminum ionic species, second type of metal ionic species, ionic liquids, organic co-solvents). In some embodiments, $R^4$ is optionally substituted $C_{13}$-$C_{30}$ alkyl or unsubstituted $C_{13}$-$C_{30}$ alkyl. In some embodiments, $R^4$ is optionally substituted $C_{16}$-$C_{30}$ alkyl or unsubstituted $C_{16}$-$C_{30}$ alkyl. In some embodiments, each $R^5$ is independently optionally substituted $C_1$-$C_{16}$ alkyl or unsubstituted $C_1$-$C_{16}$ alkyl. In some embodiments, each $R^5$ is independently optionally substituted $C_1$-$C_{12}$ alkyl or unsubstituted $C_1$-$C_{12}$ alkyl. In some embodiments, each $R^5$ is independently optionally substituted $C_1$-$C_8$ alkyl or unsubstituted $C_1$-$C_8$ alkyl. In some embodiments, each $R^5$ is methyl. In some embodiments, $R^4$ is hexadecyl. In some embodiments, $[R^4N(R^5)_3]^+[Z^-]$ is hexadecyltrimethylammonium chloride. The additive $[R^4N(R^5)_3]^+[Z^-]$ may be present in any suitable amount, for example, in an amount between about 0.001 and about 30 wt %, between about 0.01 and about 30 wt %, between about 0.1 and about 30 wt %, between about 0.1 and about 25 wt %, between about 0.1 and about 20 wt %, between about 0.1 and about 15 wt %, between about 0.1 and about 10 wt %, between about 0.1 and about 5 wt %, between about 1 and about 30 wt %, between about 5 and about 30 wt %, between about 10 and about 30 wt %, between about 15 and about 30 wt %, between about 20 and about 30 wt %, about 0.001, about 0.01, about 0.1, about 0.5 wt %, about 1 wt %, about 2 wt %, about 3 wt %, about 4 wt %, about 5 wt %, about 10 wt %, about 15 wt %, about 20 wt %, about 25 wt %, or about 30 wt %, versus the total bath composition. $Z^-$ may be any suitable anion. Non-limiting examples of anions include halide, nitrate, nitrite, carbonate, phosphite, phosphate, sulphite, sulphate, and triflate. In some embodiments, $Z^-$ is a halide. In some embodiments, $Z^-$ is chloride. In some embodiments, the anion of the additive and the counter anion of the aluminum ionic species are the same. In some embodiments, the anion of the additive, the counter anion of aluminum ionic species, and the counter anion of the second type of metal ionic species are the same. In some embodiments, $Z^-$ is chloride.

In some embodiments, an electrodeposition bath for depositing an aluminum alloy comprises aluminum ionic species, optionally a second type of metal ionic species, an ionic liquid, an organic co-solvent, and an additive comprising a polymer. Various components of the bath are described herein (e.g., aluminum ionic species, second type of metal ionic species, ionic liquids, organic co-solvents). In some embodiments, the polymer comprises a plurality of aromatic rings (e.g., either in the backbone or on the side chains). In some embodiments, the polymer is unsaturated (e.g., comprising a plurality of double or triple bonds in the backbone). In some embodiments, the polymer comprises a polystyrene polymer. In some embodiments, the additive is polystyrene. In some embodiments, the polymer comprises a styrenic copolymer which is a copolymer of styrene with another monomer, like butadiene or allyl alcohol. In some cases, copolymers including those formed from styrene and another monomer (e.g., random or block copolymers). The polymer may have any suitable molecular weight. In some embodiments, the molecular weight of the polymer is between about 500 and about 1,000,000, or between about 500 and about 500,000, or between 500 and about 250,000, or between about 500 and about 100,000, or between about 500 and about 50,000, or between 5,000 and 100,000, or between about 5,000 and about 50,000, or between about 10,000 or about 100,000. In some cases, the molecular weight is about 500, about 1000, about 5000, about 10,000, about 25,000, about 50,000, about 100,000, about 200,000, about 300,000, about 400,000, about 500,000, about 600,000, about 700,000, about 800,000, about 900,000, or about 1,000,000. In some embodiments, the molecular weight of the polymer is chosen so that the polymer is soluble in the electrolyte. The additive comprising the polymer (e.g., polystyrene) may be present in any suitable amount, for example, in an amount between about between about 0.001 and about 30 wt %, between about 0.01 and about 30 wt %, between about 0.1 and about 30 wt %, between about 0.1 and about 25 wt %, between about 0.1 and about 20 wt %, between about 0.1 and about 15 wt %, between about 0.1 and about 10 wt %, between about 0.1 and about 5 wt %, between about 1 and about 30 wt %, between about 5 and about 30 wt %, between about 10 and about 30 wt %, between about 15 and about 30 wt %, between about 20 and about 30 wt %, about 0.001, about 0.01, about 0.1, about 0.5 wt %, about 1 wt %, about 2 wt %, about 3 wt %, about 4 wt %, about 5 wt %, about 10 wt %, about 15 wt %, about 20 wt %, about 25 wt %, or about 30 wt %, versus the total bath composition In some embodiments, the electrodeposition baths described herein may comprise more than one type of additive. For example, the electrodeposition bath may comprise one or more additives having the formula $[R^3SO_4]^-[M^+]$, wherein $R^3$ and $M^+$ are as described herein, one or more additives having the formula $[R^4N(R^5)_3]^+[Z^-]$, wherein $R^4$, $R^3$, and $Z^-$ are as described herein, one or more additives having the formula:

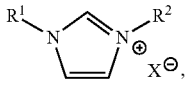

wherein $R^1$, $R^2$, and $X^-$ are as described herein, and/or one or more polymers (e.g., comprising polystyrene and/or a styrenic copolymer).

Those of ordinary skill in the art will be aware of suitable aluminum ionic species to use in connection with the baths and methods provided herein. In some embodiments, the aluminum ionic species is provided to the bath as a salt. In some embodiments, the aluminum ionic species comprises aluminum halide. In some embodiments, the aluminum ionic species comprises aluminum chloride. The aluminum ionic species may be present in any suitable amount. In some embodiments, the aluminum ionic species is present in an amount between about 1 and about 80 wt %, between about 5 and about 80 wt %, between about 10 and about 80 wt %, between about 15 and about 80 wt %, between about 20 and about 80 wt %, between about 5 and about 70 wt %, between about 5 and about 60 wt %, between about 5 and about 50 wt %, between about 5 and about 40 wt %, between about 5 and about 30 wt %, between about 10 and about 70 wt %, between about 10 and about 60 wt %, between about 10 and about 50 wt %, between about 10 and about 40 wt %, between about 10 and about 30 wt %, between about 20 and about 70 wt %, between about 20 and about 60 wt %, between about 20 and about 50 wt %, between about 20 and about 40 wt %, between about 20 and about 30 wt %, between about 30 and about 70 wt %, between about 40 and about 70 wt %, between about 50 and about 70 wt %, between about 50 and about 65 wt %, about 1 wt %, about 5 wt %, about 10 wt %, about 15 wt %, about 20 wt %, about 30 wt %, about 40 wt %, about 50 wt %, about 60 wt %, about 65 wt %, about 70 wt %, or about 80 wt % versus the total bath composition.

Those of ordinary skill in the art will be aware of suitable types of second metal ionic species to use in connection with the baths and methods provided herein. In some embodiments, the second type of metal ionic species is provided to the bath as a salt. Non-limiting examples of salts include halide, nitrate, nitrite, carbonate, phosphite, phosphate, sulphite, sulphate, and triflate. In some embodiments, the second type of metal ionic species is provided as a halide salt. In some embodiments, the second type of metal ionic species is provided as a chloride salt. In some embodiments, the methods or systems described herein comprise aluminum ionic species, a second type of metal ionic species, and at least one additional type of metal ionic species. In some cases, the methods or systems describe herein comprise aluminum ionic species, a second type of metal ionic species, a third type of metal ionic species, or any other appropriate number of metallic ionic species. In such embodiments, the alloy formed may comprise the aluminum ionic species, and/or the second type of metal ionic species, and/or the third type of metal ionic species. In some embodiments, wherein the bath comprises the aluminum ionic species, a second type of metal ionic species, a third type of metal ionic species, and a fourth type of metal ionic species, the alloy formed may comprise the aluminum ionic species, and/or the second type of metal ionic species, and/or the third type of metal ionic species, and/or the fourth type of metal ionic species.

Non-limiting examples of types of metal ionic species include Sc, Ti, V, Cr, Mn Fe, Co, Ni, Cu, Y, Zr, Nb, Mo, Tc, Rh, Ru, Ag, Cd, Pt, Pd, Ir, Hf, Ta, W, Re, Os, Li, Mg, Be, Ca, Sr, Ba, Ra, Zn, Au, U, Si, Ga, Ge, In, Tl, Sn, Sb, Pb, Bi, and Hg. In one specific embodiment, the second type of metal ionic species comprises manganese. In some embodiments, the second type of metal ionic species comprises manganese halide. In some embodiments, the second type of metal ionic species comprises manganese chloride. The second type of metal ionic species (or third type, fourth type, etc.) may be provided in any suitable amount, for example, between about 0.0001 and about 99.99 wt %, between about 0.001 and about 99.9 wt %, between about 0.01 and about 99.9 wt %, between about 0.1 and about 99 wt %, between about 0.01 and about 90 wt %, between about 0.01 and about 80 wt %, between about 0.01 and about 70 wt %, between about 0.01 and about 60 wt %, between about 0.01 and about 50 wt %, between about 0.01 and about 40 wt %, between about 0.01 and about 30 wt %, between about 0.01 and about 20 wt %, between about 0.01 and about 10 wt %, between about 0.1 and about 50 wt %, between about 0.1 and about 40 wt %, between about 0.1 and about 30 wt %, between about 0.1 and about 20 wt %, between about 0.1 and about 10 wt %, between about 1 and about 50 wt %, between about 1 and about 40 wt %, between about 1 and about 30 wt %, between about 1 and about 20 wt %, between about 1 and about 10 wt %, between about 10 and about 50 wt %, between about 10 and about 40 wt %, between about 10 and about 30 wt %, between about 10 and about 20 wt %, about 0.0001 wt %, about 0.001 wt %, about 0.01 wt %, about 0.1 wt %, about 0.5 wt %, about 1 wt %, about 5 wt %, about 10 wt %, about 15 wt %, about 20 wt %, about 30 wt %, about 40 wt %, about 50 wt %, about 60 wt %, about 65 wt %, about 70 wt %, about 80 wt %, about 90 wt %, about 95 wt %, or about 99 wt %, versus the total bath composition.

Those of ordinary skill in the art will be aware of suitable ionic liquids to use in connection with the electrodeposition baths and methods described herein. The term "ionic liquid" as used herein is given its ordinary meaning in the art and refers to a salt in the liquid state. In embodiments wherein an electrodeposition bath comprises an ionic liquid, this is sometimes referred to as an ionic liquid electrolyte. The ionic liquid electrolyte may optionally comprise other liquid components, for example, an organic solvent, as described herein. An ionic liquid generally comprises at least one cation and at least one anion. In some embodiments, the ionic liquid comprises an imidazolium, pyridinium, pyridazinium, pyrazinium, oxazolium, triazolium, pyrazolium, pyrrolidinium, piperidinium, tetraalkylammonium or tetraalkylphosphonium salt. In some embodiments, the cation is an imidazole, a pyridine, a pyridazine, a pyrazine, a oxazole, a triazole, or a pyrazole. In some embodiments, the ionic liquid comprises an imidazolium cation. In some embodiments, the anion is a halide. In some embodiments, the ionic liquid comprises a halide anion and/or a tetrahaloaluminate anion. In some embodiments, the ionic liquid comprises a chloride anion and/or a tetrachloroaluminate anion. In some embodiments, the ionic liquid comprises tetrachloroaluminate or bis(trifuoromethylsulfonyl)imide. In some embodiments, the ionic liquid comprises butylpyridinium, 1-ethyl-3-methylimidazolium, 1-butyl-3-methylimidazolium, benzyltrimethylammonium, 1-butyl-1-methylpyrrolidinium, 1-ethyl-3-methylimidazolium, or trihexyltetradecylphosphonium. In some embodiments, the ionic liquid comprises 1-ethyl-3-methylimidazolium chloride.

In some embodiments, the organic co-solvent is an aromatic solvent. In some embodiments, the organic co-solvent is selected from the group consisting of toluene, benzene, tetralin (or substituted versions thereof), ortho-xylene, meta-xylene, para-xylene, mesitylene, halogenated benzenes including chlorobenzene and dichlorobenzene, and methylene chloride. In some embodiments, the organic co-solvent is toluene. The organic co-solvent may be present in any suitable amount. In some embodiments, the organic co-solvent is present in an amount between about 1 vol % and 99 vol %, between about 10 vol % and about 90 vol %, between about 20 vol % and about 80 vol %, between about 30 vol % and about 70 vol %, between about 40 vol % and about 60 vol %, between about 45 vol % and about 55 vol %, or about 50 vol % versus the total bath composition. In some embodiments, the organic co-solvent is present in an amount greater than about 50 vol %, 55 vol %, 60 vol %, 65 vol %, 70 vol %, 80 vol %, or 90 vol % versus the total bath composition. In some embodiments, the organic co-solvent and the ionic liquid form a homogenous solution.

The specific organic co-solvent (also referred to herein as cosolvent) to be used may be selected based upon any number of desired characteristics including, for example, viscosity, conductivity, boiling point, and other characteristics as would be apparent to one of ordinary skill in the art.

One or more organic co-solvents may be mixed with the ionic liquid in any desired ratio to provide the desired electrolyte bath properties. The choice of the specific organic co-solvent and the organic co-solvent concentration may depend upon the desired deposition parameters. For example, in one embodiment, the organic co-solvent concentration may be selected to provide an electrolyte (e.g., comprising the ionic liquid and the organic cosolvent) with a specific conductivity, boiling point, viscosity, and/or appearance of the deposited material. Thus, the specific organic co-solvent and the organic co-solvent concentration may be selected to provide a conductivity greater than approximately 15 mS/cm, 16 mS/cm, 17 mS/cm, 18 mS/cm, 19 mS/cm, 20 mS/cm, 21 mS/cm, 22 mS/cm, 23 mS/cm, 24 mS/cm, and 25 mS/cm as measured at a temperature of approximately 30° C. In addition, the specific organic co-solvent and the organic co-solvent concentration may be selected to provide a conductivity less than approximately 32 mS/cm, 31 mS/cm, 30 mS/cm, 29 mS/cm, 28 mS/cm, 27 mS/cm, 26 mS/cm, 25 mS/cm, 24 mS/cm, 23 mS/cm, 22 mS/cm, 21 mS/cm, 20 mS/cm, 19 mS/cm, 18 mS/cm, and 17 mS/cm as measured at a temperature of 30° C. Combinations of the above referenced ranges are possible (e.g., a conductivity of the electrolyte comprising the ionic liquid and the organic co-solvent may be between approximately 17 mS/cm and 22 mS/cm as measured at a temperature of 30° C.). Other ranges are also possible. As another example, in some embodiments, the co-solvent may also be selected based on its boiling point. In some cases, a higher boiling point co-solvent may be employed as it can reduce the amount and/or rate of evaporation from the electrolyte, and thus, may aid in stabilizing the process. Those of ordinary skill in the art will be aware of the boiling points of the co-solvents described herein (e.g., toluene, 111° C.; methylene chloride, 41° C.; 1,2-dichlorobenzene, 181° C.; o-xylene, 144° C.; and mesitylene, 165° C.). While specific co-solvents and their boiling points are listed above, other co-solvents are also possible. Furthermore, in some embodiments the co-solvent is selected based upon multiple criteria including, but not limited to, conductivity, boiling point, and viscosity of the resulting electrolyte bath.

In some embodiments, methods of depositing aluminum or an aluminum alloy are provided comprising providing an anode, a cathode, an electrodeposition bath associated with the anode and the cathode, and a power supply connected to the anode and the cathode; and driving the power supply to electrodeposit aluminum or an aluminum alloy on the cathode, wherein the electrodeposition bath is as described herein. The methods may employ the baths described herein.

In some embodiments, methods of analyzing a metal ionic species in a metal alloy electrodeposition bath comprising aluminum chloride, a second type of metal ionic species, and an ionic liquid are provided. In some cases, the method comprises removing a sample from the electrodeposition bath and adding a solution comprising alcohol to the sample. Without wishing to be bound by theory, the alcohol may safely neutralize any reactive materials (e.g., aluminum chloride) contained in the test sample. Non-limiting examples of alcohols include ethanol, propanol (including isopropanol), and butanol. Any suitable amount of alcohol may be added to the test solution. In some cases, the amount of alcohol added is about 1 mL alcohol per 1 g sample, about 2 mL alcohol per 1 g sample, about 3 mL alcohol per 1 g sample, about 4 mL alcohol per 1 g sample, about 5 mL alcohol per 1 g sample, about 6 mL alcohol per 1 g sample, about 7 mL alcohol per 1 g sample, about 8 mL alcohol per 1 g sample, about 9 mL alcohol per 1 g sample, or about 10 mL alcohol per 1 g sample. After addition of the alcohol, water may be added to form a test solution. The test solution may be homogenous. In some cases, the final volume of the test solution may be precisely known (e.g., via use of a volumetric flask). The final volume of the test solution may be any suitable volume. In some cases, the final volume is 100 mL for a 1 g sample, 150 mL for a 1 g sample, 200 mL for a 1 g sample, 250 mL for a 1 gram sample, 300 mL for a 1 gram sample, 400 mL for a 1 g sample, or 500 mL for a 1 gram sample. The test solution may then be analyzed to determine the concentration of aluminum ionic species and/or the second type of metal ionic species in the electrodeposition bath. Those of ordinary skill in the art will be aware of methods and techniques for determining the concentration of metal ionic species in an aqueous solution, for example, using spectrophometric methods, potentiometric titrations, and/or atomic absorption spectroscopy. In some cases, manganese concentration is determined using a spectrophotometric method involving the addition of a chemical indicator, for example, 1-(2-pyridylazo)-2-naphthol (PAN). In some cases, aluminum concentration is determined using a potentiometric titration involving the addition of a complexing agent, for example, 1,2-diaminocyclohexanetetraacetic acid (DCTA).

In some embodiments, methods of analyzing an additive in an aluminum alloy electrodeposition bath are provided comprising providing an electrodeposition bath comprising aluminum ionic species, a second type of metal ionic species, an ionic liquid, and at least one type of additive; plating an aluminum alloy on a rotating disk electrode; and determining the concentration of at least one additive based at least in part on visual observation and/or instrumented measurement of the plated aluminum alloy. For example, visual observation of color and reflectivity, profilometry to evaluate surface roughness, SEM/EDS to measure alloy composition, XRD to evaluate phase composition and grain size, guided bend test to measure ductility, micro- or nano-indentation to measure hardness. Also, see, for example, the Example entitled "Additive Concentration".

In some embodiments, methods of replenishing a metal ionic species in an aluminum alloy electrodeposition bath are provided comprising providing an electrodeposition bath comprising aluminum ionic species, a second type of metal ionic species, and an ionic liquid; forming a saturated solution of the second type of metal ionic species, wherein the saturated solution comprises an ionic liquid; and adding a portion of the saturated solution to the electrodeposition bath to increase the concentration of the metal ionic species in the electrodeposition bath. Without wishing to be bound by theory, such methods may reduce the amount of time necessary to replenish the concentration of the metal ionic species in the bath as compared to traditional methods. Those of ordinary skill in the art will be aware of suitable techniques and methods for forming a saturated solution. In some cases, the method comprises agitation and/or heating. In some embodiments, the bath comprises an additive as described herein. In some embodiments, the methods of replenishing may be carried out using an automated system, as described herein.

The term "alkyl" is given its ordinary meaning in the art and refers to the radical of saturated aliphatic groups, including straight-chain alkyl groups, branched-chain alkyl groups, cycloalkyl (alicyclic) groups, alkyl substituted cycloalkyl groups, and cycloalkyl substituted alkyl groups. In some embodiments, a straight chain or branched chain alkyl may have 30 or fewer carbon atoms in its backbone, and, in some cases, 20 or fewer. In some embodiments, a straight chain or branched chain alkyl may have 12 or fewer carbon atoms in its backbone (e.g., $C_1$-$C_{12}$ for straight chain, $C_3$-$C_{12}$ for branched chain), 6 or fewer, or 4 or fewer. Likewise, cycloalkyls may have from 3-10 carbon atoms in their ring structure, or 5, 6, or 7 carbons in the ring structure. Non-limiting examples of $C_1$-$C_{30}$ alkyl groups include methyl, ethyl, propyl, butyl, pentyl, hexyl, octyl, nonyl, decyl, undecyl, dodecyl, tridecyl, tetradecyl, pentadecyl, hexadecyl, heptadecyl, octadecyl, nonadecyl, eicosyl, and isomers thereof (ie., including cyclic groups such as cyclopropyl, cyclobutyl, cyclopentyl, cyclohexyl, etc.). Non-limiting examples of $C_8$-$C_{30}$ groups include octyl, nonyl, decyl, undecyl, dodecyl, tridecyl, tetradecyl, pentadecyl, hexadecyl, heptadecyl, octadecyl, nonadecyl, eicosyl, and isomers thereof (ie., including cyclic groups).

The term "heteroalkyl" is given its ordinary meaning in the art and refers to alkyl groups as described herein in which one or more atoms is a heteroatom (e.g., oxygen, nitrogen, sulfur, and the like). Examples of heteroalkyl groups include, but are not limited to, alkoxy, poly(ethylene glycol)-, alkyl-substituted amino, tetrahydrofuranyl, piperidinyl, morpholinyl, etc.

The term "aryl" is given its ordinary meaning in the art and refers to aromatic carbocyclic groups, optionally substituted, having a single ring (e.g., phenyl), multiple rings (e.g., biphenyl), or multiple fused rings in which at least one is aromatic (e.g., 1,2,3,4-tetrahydronaphthyl, naphthyl, anthryl, or phenanthryl). That is, at least one ring may have a conjugated pi electron system, while other, adjoining rings can be cycloalkyls, cycloalkenyls, cycloalkynyls, aryls and/or heterocyclyls. The aryl group may be optionally substituted, as described herein. Substituents include, but are not limited to, any of the previously mentioned substitutents, i.e., the substituents recited for aliphatic moieties, or for other moieties as disclosed herein, resulting in the formation of a stable compound. In some cases, an aryl group is a stable mono- or polycyclic unsaturated moiety having preferably 3-14 carbon atoms, each of which may be substituted or unsubstituted.

It will be appreciated that the groups and/or compounds, as described herein, may be optionally substituted with any number of substituents or functional moieties. That is, any of the above groups may be optionally substituted. As used herein, the term "substituted" is contemplated to include all permissible substituents of organic compounds, "permissible" being in the context of the chemical rules of valence known to those of ordinary skill in the art. In general, the term "substituted" whether preceded by the term "optionally" or not, and substituents contained in formulas of this invention, refer to the replacement of hydrogen radicals in a given structure with the radical of a specified substituent. When more than one position in any given structure may be substituted with more than one substituent selected from a specified group, the substituent may be either the same or different at every position. It will be understood that "substituted" also includes that the substitution results in a stable compound, e.g., which does not spontaneously undergo transformation such as by rearrangement, cyclization, elimination, etc. In some cases, "substituted" may generally refer to replacement of a hydrogen with a substituent as described herein. However, "substituted," as used herein, does not encompass replacement and/or alteration of a key functional group by which a molecule is identified, e.g., such that the "substituted" functional group becomes, through substitution, a different functional group. For example, a "substituted phenyl group" must still comprise the phenyl moiety and cannot be modified by substitution, in this definition, to become, e.g., a pyridine ring. In a broad aspect, the permissible substituents include acyclic and cyclic, branched and unbranched, carbocyclic and heterocyclic, aromatic and nonaromatic substituents of organic compounds. Illustrative substituents include, for example, those described herein. The permissible substituents can be one or more and the same or different for appropriate organic compounds. For purposes of this invention, the heteroatoms such as nitrogen may have hydrogen substituents and/or any permissible substituents of organic compounds described herein which satisfy the valencies of the heteroatoms. Furthermore, this invention is not intended to be limited in any manner by the permissible substituents of organic compounds.

Examples of substituents include, but are not limited to, halogen, azide, alkyl, aralkyl, alkenyl, alkynyl, cycloalkyl, hydroxyl, alkoxyl, amino, nitro, sulfhydryl, imino, amido, phosphonate, phosphinate, carbonyl, carboxyl, silyl, ether, alkylthio, sulfonyl, sulfonamido, ketone, aldehyde, ester, heterocyclyl, aromatic or heteroaromatic moieties, —CF3, —CN, aryl, aryloxy, perhaloalkoxy, aralkoxy, heteroaryl, heteroaryloxy, heteroarylalkyl, heteroaralkoxy, azido, amino, halide, alkylthio, oxo, acylalkyl, carboxy esters, carboxamido, acyloxy, aminoalkyl, alkylaminoaryl, alkylaryl, alkylaminoalkyl, alkoxyaryl, arylamino, aralkylamino, alkylsulfonyl, carboxamidoalkylaryl, carboxamidoaryl, hydroxyalkyl, haloalkyl, alkylaminoalkylcarboxy, aminocarboxamidoalkyl, cyano, alkoxyalkyl, perhaloalkyl, arylalkyloxyalkyl, and the like.

While the above has been directed to describing an electrodeposition bath for depositing aluminum or an aluminum alloy, the current disclosure of ionic liquid compositions, additives, and/or cosolvents is not limited to use only with aluminum-based materials. For example, instead of using aluminum as the primary ionic metal species, another metal such as titanium, nickel, copper, gold, a refractory metal, zinc or any other appropriate metal can be used as the primary ionic metal species for the electrodeposition process.

Electrodeposition Systems for Use with Ionic Liquid Based Electrolyte Baths

In developing a reactor design for use with the above disclosed electrolyte chemistries and analytical methods, a number of factors were taken into account. Specifically, as noted above, the ionic liquids can be extremely corrosive as compared to traditional aqueous based electrolytes used in other electrodeposition systems. Further, many of the materials and methods used in prior electrodeposition systems can be incompatible with the corrosive these ionic liquids. As described in more detail below in the example section, testing was conducted to determine the compatibility and wettability of various materials with regards to the ionic liquid electrolyte, additives, and salts, such as aluminum chloride, used in the currently disclosed electrolyte baths. Materials determined to be substantially compatible with the ionic liquid electrolyte include, but are not limited to, polytetrafluoroethylene, perfluoroalkoxy, fluorinated ethylene propylene, glass, alumina, quartz, silicon carbide, stainless steel, titanium alloys, para-aramid polymers, thiolene, nickel alloys (e.g. nickel-chromium-iron alloys and nickel superalloys), zirconium alloys, and refractory metals. While certain of the above materials are substantially inert with regards to the ionic liquids and are capable of continued use in such an environment, certain materials such as the metals and metal alloys are resistant to corrosion by the ionic liquids and may be used for a predetermined amount of time prior to needing to be replaced. The above noted material can be used to construct the various reactor components.

As depicted in FIGS. 1-3A an electrodeposition reactor 100 includes a tank 102 for containing the electrolyte bath and associated anodes and cathodes. The tank includes an interior tank 102*a* and an exterior tank 102*b*. Since the interior tank 102*a* is in direct contact with the corrosive electrolyte bath, the interior tank 102*a* is constructed from a material compatible with the ionic liquid electrolyte. Due to manufacturing difficulties associated with some of the above noted materials, such as polytetrafluoroethylene, in some embodiments, the interior tank 102*a* is a liner, a coating, or other thin construction that needs a structural backing. In such instances, the exterior tank 102*b* may be constructed and arranged to act as a structural backing to support the interior tank 102*a*. In other embodiments, the interior tank 102*a* is structurally rigid and the exterior tank 102*b* functions as a secondary container and/or provides an additional benefit. For example, in some embodiments, it may be desirable for exterior tank 102*b* to provide thermal insulation to the interior tank 102*a* to improve the thermal efficiency of the system when maintained within a preselected temperature range by a heater 122. While separate interior and exterior tanks have been depicted, it should be understood that the interior and exterior tanks could be integrally formed with one another and/or bonded together. Further, embodiments in which a single tank is used, as well as embodiments in which a plurality of interfitting tanks are used, are envisioned as the current disclosure is not limited in this fashion.

Unlike small-scale electrodeposition, such as limited run laboratory electrodeposition, contamination of the ionic liquid electrolyte during high rate, long-term, and/or continuous plating processes may necessitate filtration of the electrolyte. Possible contaminant and particulate sources during an electrodeposition process include both external sources as well as contaminants formed within the reactor from the electrodeposition process itself. Consequently, in the currently depicted embodiment, the tank is fluidly coupled with a plumbing system comprising a filter 104, a bypass 106, and a pump 108 for circulating the ionic liquid electrolyte bath. In some embodiments, the plumbing system is capable of turning the electrolyte volume over once per minute, twice per minute, or any other applicable rate. Again, due to the corrosive nature of the ionic liquid based electrolyte bath appropriate filters are selected for use with the reactor. Some non-limiting examples of appropriate filters include, but are not limited to, polytetrafluoroethylene disks, stretched polytetrafluoroethylene membranes, wound para-aramid fiber filters, ceramic filters, fluoropolymer filter cartridges, nickel alloy foam filters, and other appropriate filters, including frit filters, comprising materials that are substantially compatible with, and in some instances wettable by, the electrolyte bath. In some embodiments, multiple in-line filters are used to progressively filter the electrolyte flowing therethrough. For example, a first filter may have a first filtration or pore size that is greater than a second filtration or pore size of a second filter. Thus, larger contaminants are filtered by the first filter and smaller contaminants are filtered by the second filter. Additional filters can also be used in such an embodiment to provide additional filtration.

As noted above, the plumbing system also includes a bypass 106. Depending on the embodiment, bypass 106 may be either manually, or automatically controlled, as the current disclosure is not limited in the way in which bypass 106 is controlled. Bypass 106 can be used to manipulate the flow of electrolyte relative to filter 104. For example, filter 104 can be isolated by closing associated valves on either side, not depicted, and allowing the electrolyte to flow entirely through bypass 106. In such a configuration, filter 104 may be changed out or undergo maintenance procedures while maintaining continuous flow of the electrolyte through bypass 106. In addition to permitting flow of electrolyte through the system during maintenance procedures of the filter, bypass 106 may also be controlled to alter the amount of filtration and flow of electrolyte. If bypass 106 is completely closed, all of the electrolyte will flow through filter 104. Alternatively, bypass 106 may be partially, or fully, open to allow flow of electrolyte through both filter 104 and bypass 106. Without wishing to be bound by theory, in such a configuration, the flow of electrolyte through the system can be increased while still filtering at least a portion of the electrolyte.

To ensure a uniform distribution of ions, additives, and other components taking part in the electrodeposition process, it is desirable for the plumbing system to include a fluid distribution system 112 capable of uniformly circulating the ionic liquid electrolyte throughout the tank 102. Such a system may beneficially circulate fresh electrolyte to regions adjacent the deposition surfaces. In such an embodiment, pressurized ionic liquid electrolyte is provided by pump 108 to tank inlet 110. Tank inlet 110 is connected to a fluid distribution system 112. The fluid distribution system 112 is constructed and arranged to provide a substantially uniform flow of electrolyte to the deposition surfaces located on the corresponding one or more cathodes immersed in the electrolyte bath. The fluid distribution system 112 may include any appropriate flow configuration including, for example, an arrangement of nozzles, an arrangement of eductors, a sparger, a flow cell, and/or any other appropriate fluid distribution component or combination of components. Furthermore, the fluid distribution system 112 can also include a combination of the above components. In some embodiments, the fluid distribution system 112 flows the electrolyte bath in a substantially uniform direction at a substantially uniform velocity greater than approximately 0.001 m/s, 0.01 m/s, 0.1 m/s, 1 m/s, 10 m/s, 50 m/s, and other appropriate velocities. Correspondingly, the fluid flow may be less than approximately 100 m/s, 50 m/s, 10 m/s, 1 m/s, 0.1 m/s, 0.01 m/s, and other appropriate velocities. Combinations of the above are possible including, for example, the velocity may be between approximately 0.001 m/s to approximately 100 m/s. Other combinations are also possible.

In some embodiments, it is desirable that the flow of electrolyte be controlled to provide a substantially uniform flow of electrolyte across the deposition surfaces. Depending on the substrate geometry, laminar or turbulent flow may be desirable. For example, turbulent flow may be desirable when the electrodeposition surface includes features that are occluded from the electrolyte flow. Without wishing to be bound by theory, in such an instance, the turbulent flow will aid in mixing the electrolyte adjacent to the occluded feature with the electrolyte from the turbulent flow. Thus, the uniformity of the flow and concentration of active species within the electrolyte can be made more uniform across the entire electrodepostion surface including the areas that are occluded from the flow resulting in a more uniform electrodeposition process. In other instances, a laminar flow is more desirable. For example, due to the difficulty in obtaining a uniform turbulent flow across a flat surface regions of high flow and low flow may occur. As described in more detail below in regards to FIG. 15, the electrodeposition process is sensitive to the flow rate. Therefore, in some embodiments, such as electrodeposition onto smooth surfaces that are not occluded from the electrolyte flow, it may be desirable to provide a laminar flow of electrolyte to the electrodeposition surface.

Regardless of the fluid distribution system used, some degree of nonuniform flow and/or concentration gradients may still exist within the electrolyte bath. Consequently, in some embodiments, it may be desirable to provide cathode movement relative to the flow within the electrolyte bath and/or fluid agitation so as to create relative movement between the deposition surfaces of the cathodes and the fluid. In such an embodiment, the deposition surfaces are beneficially moved through the varying regions of nonuniform flow and concentration gradients resulting in an averaged flow and concentration characteristic for the electrodeposition process. Without wishing to be bound by theory, it is believed that this will result in a more uniform electrodeposition process. In such an embodiment, one or more cathode rockers, bath agitators, fluid flow cells, or other appropriate system, moves the one or more deposition surfaces, or the electrolyte within the electrolyte bath, in a direction that has at least a component that is substantially orthogonal to the flow direction provided by the fluid distribution system 112. The deposition surfaces, or the electrolyte within the electrolyte bath, are moved in this second direction at a velocity greater than approximately 0.001 m/s, 0.01 m/s, 0.1 m/s, 1 m/s, 10 m/s, 50 m/s, and other appropriate velocities. Correspondingly, the one or more deposition surfaces are moved at a velocity less than approximately 100 m/s, 50 m/s, 10 m/s, 1 m/s, 0.1 m/s, 0.01 m/s, and other appropriate velocities. Combinations of the above are possible including, for example, the one or more deposition surfaces may be moved at a velocity between approximately 0.001 m/s to approximately 100 m/s. Other combinations are also possible.

In the depicted embodiment, reactor 100 includes racks 114 for holding and positioning one or more anodes and the corresponding one or more cathodes. As depicted, the racks 114 include grooves 118 for retaining conductive rods 116 electrically and supportively coupled to the anode(s) and cathode(s). The grooves 118 and the corresponding shape of the conductive rods 116 are both shaped to retain the conductive rods 116 in place during the electrodeposition process. While a circular rod and triangular groove have been depicted any appropriate shape could be used as the current disclosure is not limited in this manner. In addition to being retained in the racks 114, conductive rods 116 may beneficially include a connection 116*a* for electrically coupling the anodes and cathodes to a control system, not depicted. Due to the easily changed connections 116*a* and rack 114, anodes and cathodes may be provided in any desired number and arrangement. For example, alternating anodes and cathodes could be provided in rack 114 to provide plating on multiple sides of the cathodes. Alternatively, a single cathode with multiple anodes could be used, or a single anode with multiple cathodes could be used as the current disclosure is not limited to any specific arrangement of anodes and cathodes.

In some embodiments, tank 102 includes a plurality of separate compartments. These compartments can be used for any number of different applications. For example, in one embodiment, one or more compartments are adapted for performing the electrodeposition process. Separate compartments are then used for holding and/or activating replenisher solutions as described in more detail below. Filtration and/or other electrolyte bath maintenance are conducted in additional separate compartments. Further, any combination of the above types of compartments could be used. Additionally, depending upon the embodiment, the individual compartments may be used for any one of the desired applications such that the tank 102 offers a flexible and in some instances scalable, electrodeposition system.

As shown in FIGS. 2 and 3A, the depicted embodiment of reactor 100 includes a sensor assembly 120. Sensor assembly 120 may be a single sensor adapted to measure a single processing parameter, or it may incorporate a plurality of sensors. Alternatively, multiple sensor assemblies could be included in different portions of the tank 102 for measuring different processing parameters. Processing parameters that could be advantageously measured using various sensors and sensing methods, including those currently disclosed, include but are not limited to, electrolyte bath levels, additive concentrations, ion concentrations, particulate concentrations, flow rates, pressure differentials across the various fluid flow components, the temperature of the electrolyte bath, and other applicable processing variables. In one embodiment, the sensor assembly 120 is adapted to automatically sample the electrolyte bath. Alternatively, sensor assembly may incorporate various manual steps as part of the process, as the current disclosure is not limited in this manner. In either embodiment, a computer, or other device incorporating a processor, may be used to automatically control the electrolyte bath and/or electrodeposition system to maintain the electrodeposition process within predetermined operating parameters. Alternatively, the processing parameters may be manually controlled. As described in more detail below, processing parameters that could advantageously be controlled include, but are not limited to, additive concentrations, ion concentrations, electrode polarizations, cosolvent concentrations, flow velocity, temperature, pressure and/or other applicable processing parameters.

To ensure proper activation of the cathode and anode during the initial electrodeposition setup, the anode and cathode are cleaned and the surfaces are prepared for the electrodeposition process. While specific embodiments are described below, these processes may be done using any number of different cleaning and processing techniques as the current disclosure is not limited in this fashion.

Figure 4B:
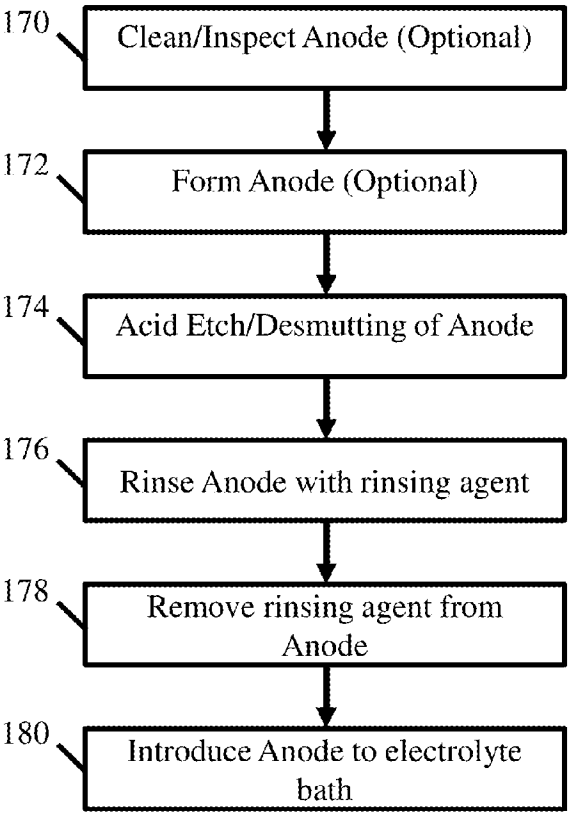
FIG. 4B is an exemplary process flow diagram for preparing the anode material.
Figure 4A:
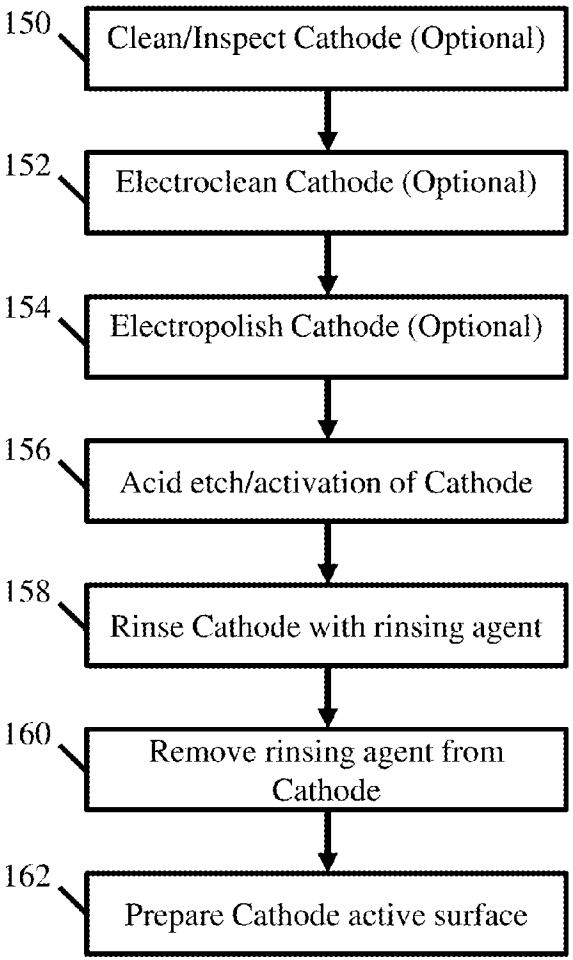
FIG. 4A is an exemplary process flow diagram for preparing the cathode material.

In one embodiment the cathode is prepared by first cleaning and inspecting the cathode material, see 150 in FIG. 4A. In instances where the cathode material is reactive with the atmosphere, smut, grease, and/or oil used to store the materials is removed from the cathode during this cleaning process. During inspection, the dimensions and overall condition are evaluated as to whether or not they are acceptable for the electrodeposition process. It should be noted, that some cathode materials will not need to be cleaned and/or inspected prior to moving on to subsequent cathode pretreatment steps.

After cleaning and inspection, an optional electrocleaning process 152 is conducted. More specifically, in one embodiment, an electrocleaning process is applied for between approximately 0-600 seconds at approximately 10° C.-100° C. in a caustic electrocleaning solution. The electrocleaning process is conducted between 0V and 100V using either a cathodic or anodic polarization. For example, in one instance a copper cathode is electrocleaned for 30 seconds at 60° C. with a 6V cathodic polarization. After electrocleaning, the cathode material is rinsed with water such as distilled or deionized water to remove residual electrocleaning solution. The cathode material is then kept wet until the next step.

Without wishing to be bound by theory, polishing the cathode surface to reduce the surface roughness and number of defects may delay the onset of dendritic growth due to the reduction in the number of possible dendrite nucleation sites. Therefore, after electrocleaning the cathode is subjected to an optional electropolish. Electropolishing for the cathode includes etching the cathode in an electropolish solution between approximately 0.1 V to approximately 20 V cathodic polarization for between 0.1 seconds to 600 seconds. For example, the cathode could be electropolished at approximately 4 V for 20-30 seconds for extruded or heavily drawn materials, 12V for 20-45 seconds for rolled and annealed materials, and other appropriate electropolishes for varying types of material. After electropolishing, the cathode material is rinsed with water such as distilled or deionized water to remove residual electropolishing solution. The cathode material may optionally be kept wet until the next step.

After the optional cleaning and polishing of the cathode material, the cathode material is subjected to an acid etch/activation process 156. In one embodiment, the etching/activation process includes etching the cathode terminal for approximately 45 seconds in a 10% sulfuric acid solution at 30° C. After etching/activation, the cathode material is rinsed with water such as tap, distilled, or deionized water. The cathode material may then be optionally kept wet until the next step. To prevent interaction of water with the ionic liquid within the electrolyte bath, it is preferable to remove the water from the cathode material prior to introduction of the cathode to the electrolyte bath. In one embodiment, a rinsing agent such as an alcohol, or other appropriate solvent, is used to rinse the cathode material, see 158. Appropriate rinsing agents include, but are not limited to, low molecular weight alcohols such as ethyl alcohol, isopropyl alcohol, methyl alcohol, denatured alcohol, or other appropriate materials. In one embodiment, the rinsing solution is ethanol with less than approximately 10% water. In another embodiment, the rinsing solution is 99% ethanol. After rinsing, the rinsing agent is removed, see 160. In one embodiment, the rinsing agent is removed using an inert gas. For example, a nitrogen air knife could be used to remove the rinsing agent from the cathode material. Alternatively, the cathode material could be subjected to one or more vacuum cycles with an inert gas atmosphere as might be present during introduction of the cathode material into a glove box, or other sealed environment. In one embodiment, the cathode material undergoes approximately 5 minute cycles under vacuum and is cycled at least once, twice, three times, or any other appropriate number of times.

After removing the rinsing agent, the cathode material is introduced into the electrolyte bath, or a chemically similar bath. The active surface is then prepared for the subsequent electrodeposition process, see 162. In one embodiment, the active surface is prepared by soaking the cathode material in the electrolyte bath, or the chemically similar bath, for longer than approximately 0.1 min., 1 min., 30 min., 1 hour, 2 hours, 3 hours, 4 hours, 5 hours, 6 hours, 7 hours, 8 hours, 9 hours, 10 hours, or any other appropriate time. In addition, the cathode material is soaked for less than approximately 24 hours, 12 hours, 10 hours, 9 hours, 8 hours, 7 hours, as 6 hours, 5 hours, or any other appropriate time. For example, the cathode material could be soaked for between approximately 9 hours to approximately 12 hours. Without wishing to be bound by theory, during soaking of the cathode material, it is desirable to avoid contact with dissimilar metals and circuit bridging to avoid undesired reaction of the cathode active surface. In an alternative embodiment, the cathode material is placed into the electrolyte bath, or a chemically similar bath, and connected to a polarization control system. Subsequently, reverse current, or voltage, is supplied for at least 0.1 seconds to etch the active surface of the cathode material. In one such embodiment, the applied voltage is greater than 1V for greater than approximately 10 seconds. Correspondingly, the applied voltage is applied for less than approximately 10 min., 5 min., 1 min., 30 seconds, or any other appropriate time. Regardless of the way in which the active surface is prepared, after preparation of active surface, the cathode material is ready for the electrodeposition process.

It should be understood that the above noted process for preparing the cathode can be applied to any number of materials. Further, depending upon the specific material additional steps may be necessary, or one or more of the above-noted steps may be unnecessary. For example commercially available alloys that are stable when exposed to the environment may not require cleaning to remove smut, grease or oil from the surface. Possible cathode materials include, but are not limited to, copper, copper alloys, nickel, aluminum alloys, steel, stainless steel, titanium, magnesium, zinc, and metallized plastics.

In addition to electrocleaning, electropolishing, acid etching, and final rinsing, the substrate can be subjected to pre-plating, e.g. application of a strike layer, to improve adhesion between the cathode substrate material and the electrodeposited layer. In one embodiment, pre-plating of the cathode includes pre-plating with a thin layer of copper. Without wishing to be bound by theory, it is noted that the aluminum manganese alloys exhibit excellent adhesion with copper, though pre-plating with other materials is also possible.

In addition to preparing the cathode, the anode is also prepared for the electrodeposition process, see FIG. 4B. Similar to the above, the anode material is cleaned and inspected, see 170. For example, if the anode material is covered grease, smut, or oil, the anode material is cleaned prior to subsequent anode pretreatment steps. After cleaning and inspecting the anode material, if necessary, the anode material is formed to the desired shape for the electrodeposition process, see 172. For example, for anodes comprising pellets of anode material, the pellets are placed in a corresponding anode bag and shaped to the desired shape for the electrodeposition process. Alternatively, a solid anode might be formed to conform to the shape of a corresponding cathode. Subsequently the formed anode is soaked in an acid etch and/or de-smutting solution to prepare the active surface, see 174. In one embodiment, the acid etch and/or de-smutting solution is a solution comprising approximately 70 vol % phosphoric acid, 25 vol % sulfuric acid, and 5 vol % nitric acid. It should be noted, that the volume percentages noted above are based on stock concentrations of 70% nitric acid and 98% sulfuric acid. The anode material is immersed in the etching and/or de-smutting solution for longer than approximately 0.1 min., 1 min., 20 min., 30 min., 1 hour, 2 hours, 3 hours, 4 hours, 5 hours, 6 hours, 7 hours, 8 hours, 9 hours, 10 hours, or any other appropriate time. In addition, the anode material is immersed for less than approximately 24 hours, 12 hours, 10 hours, 9 hours, 8 hours, 7 hours, 6 hours, 5 hours, or any other appropriate time. For example, the anode material could be immersed in the etching and/or de-smutting solution for between approximately 20 min. to approximately 30 min., or until the active surface is substantially completely etched. In some instances, the soak time is decreased by flowing the solution, agitating/moving the anode material, application of heat, and/or other appropriate methods.

After etching and/or de-smutting of the anode material, the anode material is rinsed with water such as distilled or deionized water to remove residual etching and/or de-smutting solution. Subsequently, the anode material is rinsed with a rinsing agent, see 176. As noted above, appropriate rinsing agents include, but are not limited to, a low molecular weight alcohols such as ethanol alcohol, isopropyl alcohol, methanol alcohol, denatured alcohol, or other appropriate materials. In one embodiment, the rinsing solution is ethanol with less than approximately 10% water. In another embodiment, the rinsing solution is 99% ethanol. Similar to the above, it is desirable to remove the residual water and rinsing agent from the anode active surface prior to introduction to the electrolyte bath. Therefore, after rinsing, the anode material is dried through the use of compressed inert gas and/or a vacuum, see 178. Once dry, the anode is introduced into the electrolyte bath for use in the electrodeposition process, see 180.

Figure 5B:
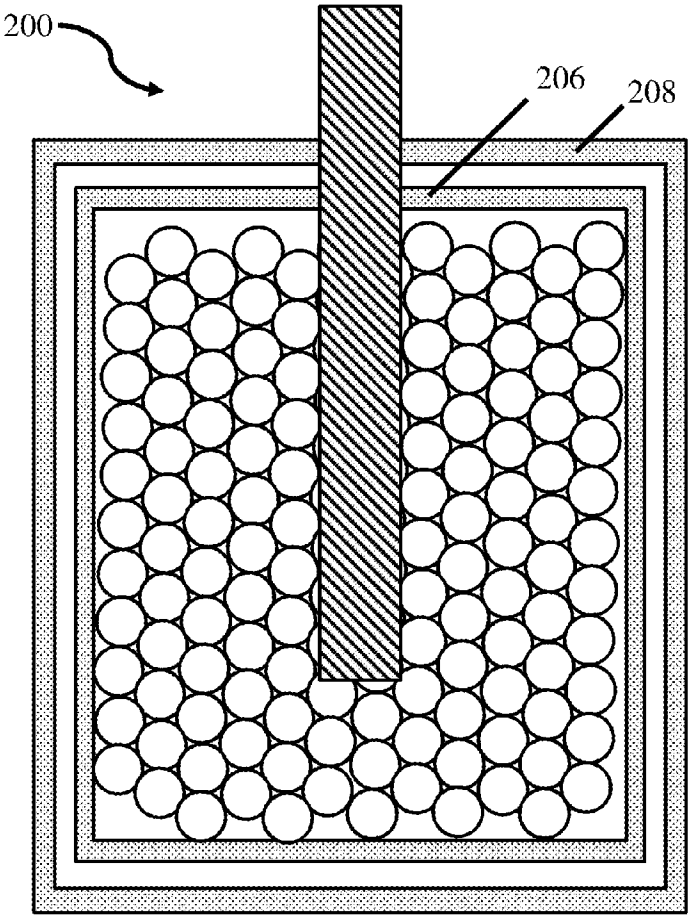
FIG. 5B is a schematic representation of a double anode bag filled with electroactive material pellets.
Figure 5A:
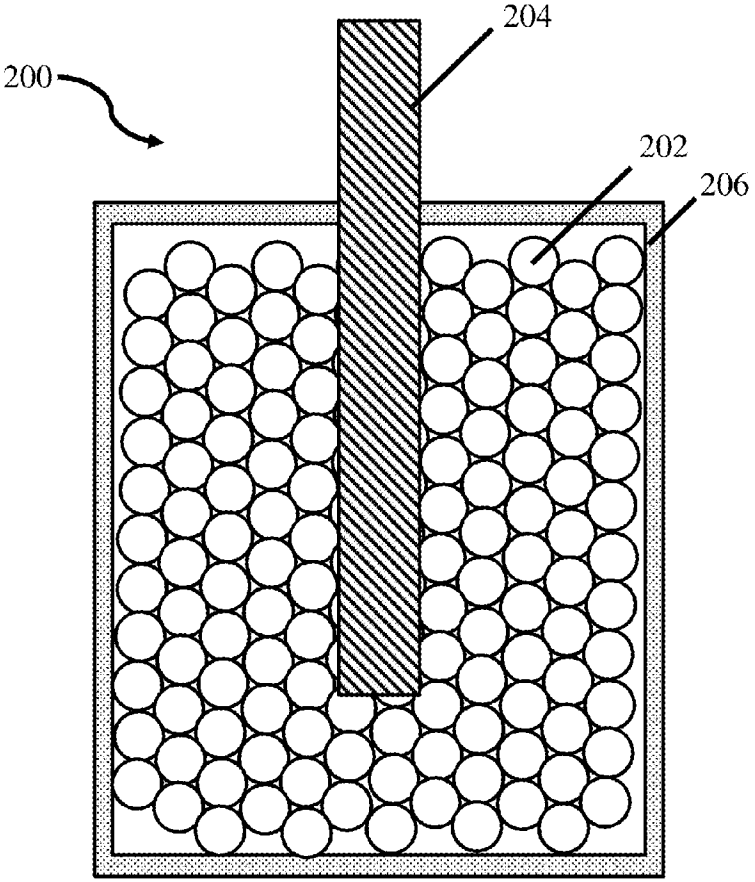
FIG. 5A is a schematic representation of an anode bag filled with electroactive material pellets.

In certain embodiments, as shown in FIGS. 5A and 5B, it may be desirable to create a barrier between the anode 200 and the surrounding ionic liquid electrolyte using one or more anode bags 206 and 208 to prevent particulates above a certain size threshold from entering the surrounding electrolyte bath. Without wishing to be bound by theory, it is believed that using an anode bag constructed and arranged to prevent particulates and contamination from the anode entering the surrounding electrolyte bath, reduces contamination of the deposition surfaces involved in the electrodeposition process which may result in a delayed onset of dendritic growth. The anode bags function by permitting ions and the electrolyte bath to pass through the anode bags while retaining contaminants and particulates generated from the anode within the bag. Similar to other components present within the ionic liquid electrolyte, the anode bags are made from materials compatible with both the ionic liquid electrolyte as well as the ions and salts contained therein. In addition, to provide uniform diffusion of electrolyte and ions across the anode bags, it is desirable that the anode bags be wettable by the ionic liquid. However, embodiments in which the anode bag material is not wettable by the ionic liquid are also envisioned. Without wishing to be bound by theory, when using an anode bag made from a material that is not wettable by the ionic liquid, it may be necessary to provide larger pore sizes to enable sufficient diffusion across the anode bag for the electrodeposition process. Compatible materials for use in an anode bag include, but are not limited to, polytetrafluoroethylene, perfluoroalkoxy, fluorinated ethylene propylene, para-aramid polymers, fiberglass, ion exchange membranes, and other appropriate materials. Composites of the above and/or other materials could also be used to form the anode bags.

The anode bags may be formed from the above materials using any appropriate method to provide a material with the desired characteristics of permitting electrolyte and ion diffusion through the material while limiting the passage of particulates and other contaminants. For example, the above materials may be embodied in any number of ways including, but not limited to fibers used to form woven and/or felted materials, membranes with pores formed therein, porous materials, and/or any other appropriate construction. Depending upon the particular material used for the anode bag, the anode bag is integrally formed, sewn together, heat sealed, or formed using any other appropriate manufacturing technique. In instances where the anode bag is sewn together, the sewing fibers can be made from the same material as the anode bag or they may be made from a different material that is compatible with the ionic liquid. For example, if desired the sewing fibers might be made from a higher-strength material that is compatible with the ionic liquid to improve the strength of the seam. In one particular embodiment, para-aramid polymer fibers, which are both compatible with and wettable by the ionic liquid, are woven together to form a material with a preselected pore size. The material is then sewn together using para-aramid polymer fibers to form the anode bag. It should be understood that other combinations of the above-noted materials can be used for forming the anode bags. For example, polytetrafluoroethylene coated fiberglass could be used to form the anode bags.

In some embodiments, the average pore size present within the anode bag is greater than approximately 0.01 μm, 0.1 μm, 1 μm, 10 μm, 20 μm, 30 μm, 40 μm, 50 μm, or any other appropriate size. In addition, the average pore size present within the material is less than approximately 100 μm, 90 μm, 80 μm, 70 μm, 60 μm, 50 μm, 40 μm, 30 μm, 20 μm, 10 μm, 1 μm, or any other appropriate size. Combinations of the above-referenced ranges are possible (e.g., an average pore size of the anode bag material may be greater than approximately 0.1 μm and less than approximately 100 μm). Other ranges are also possible.

Depending upon the particular electrodeposition process, the anode may be embodied in any number of different forms. For example, the anode may be a monolithic structure such as a sheet or rod. Alternatively, in some embodiments the anode includes active materials in the form of pellets 202, as depicted in FIGS. 5A and 5B, and/or foams to provide an increased anode surface area. It should be noted, that in aqueous based electrodeposition systems pellets and/or foams are held in electrode baskets to maintain their shape and provide electrical contact with the active material. However, the electrode baskets used in aqueous electrolyte based systems are generally made from materials that are reactive with the ionic liquid. Therefore, in embodiments using high surface area materials, such as pellets 202, one or more anode bags, or an appropriate structural container such as a basket, may be used to maintain the shape of the anode during the electrodeposition process. In addition to maintaining the shape of the anode, two or more anode bags may be used as depicted in FIG. 5B to ensure that the pellets 202 are retained even if a single anode bag is torn or damaged. Since the anode bag is generally not made from a conductive material, anodes 200 include a conductive electrical contact rod 204 disposed within, and in electrical contact with, the anode active material corresponding to pellets 202. The electrical contact rod 204 permits the anode active material corresponding to pellets 202 to be polarized to the desired polarization during the electrodeposition process.

Figure 6:
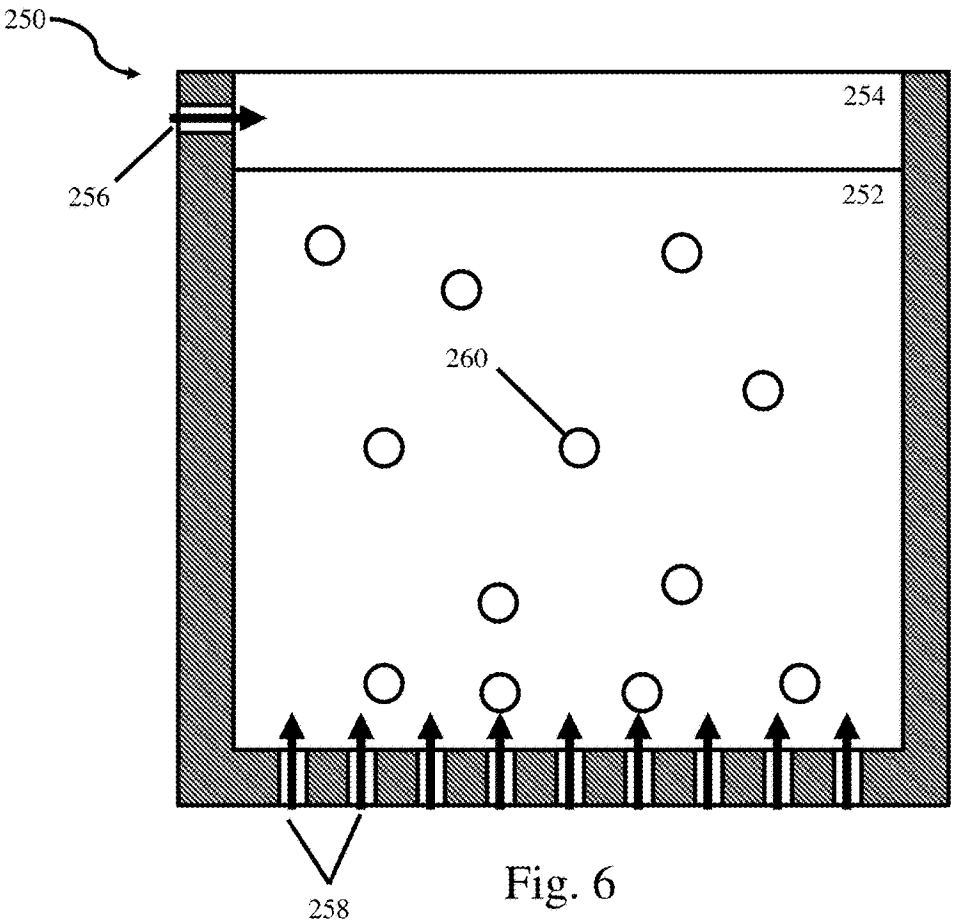
FIG. 6 is a schematic representation of an ionic liquid electrolyte with a blanket layer.

Due to the hygroscopic nature of the ionic liquids, it is desirable to provide a blanket layer 254 for the electrolyte bath 250 when the electrodeposition process is operated outside of a controlled inert atmosphere such as a glovebox, see FIG. 6. The blanket layer substantially prevents reaction of the electrolyte bath 202 with the surrounding atmosphere. Depending on the specific embodiment, the blanket layer is a liquid, gas, or combination of both a liquid and a gas. Regardless, of the specific material used for the blanket layer, the blanket layer material is at least partially immiscible with, and of a different density than, the electrolyte bath. For example, the concentration of a particular liquid within the electrolyte bath may be greater than the equilibrium solubility limit of the liquid in the electrodeposition bath. Further, in at least some embodiments, the blanket layer may have a density that is less than a density of the electrolyte bath. Consequently, the above noted liquid will phase separate from the electrolyte bath to form a blanket layer on top of the electrolyte bath. Further, the material used for the blanket layer is heavier than the surrounding atmosphere in the environment such that the blanket layer remains disposed between the electrodeposition bath and atmosphere. In some embodiments, the blanket layer is also substantially inert with the electrolyte bath.

In one embodiment, the blanket layer 254 is provided by flowing the blanket layer material over the top surface of the electrolyte 252 via an inlet 256. In an alternative embodiment, the blanket layer 254 is provided by flowing the blanket material into an interior portion of the electrolyte bath 250. Due to the lower density and immiscibility of the blanket layer material with the ionic liquid electrolyte 252, the blanket layer material passes through the ionic liquid electrolyte to the upper surface of the electrolyte bath as individual drops 260 to form blanket layer 254. Without wishing to be bound by theory, such an embodiment may advantageously help to avoid turbulent mixing of the blanket layer with the surrounding atmosphere which could lead to accelerated reaction of the electrolyte bath 252 with the surrounding atmosphere. Appropriate liquids for use as a blanket layer material include, but are not limited to, hexane, decane, paraffin, poly-alpha-olefin, toluene, and pentane. In addition, appropriate gases for use as a blanket layer material include, but are not limited to, carbon dioxide, nitrogen gas, and noble gases. While specific gases and liquids are disclosed above, the current disclosure of a blanket layer is not limited to only the specific gases and liquids disclosed herein.

In some embodiments, the thickness of the blanket layer is greater than approximately 0.5 mm, 1 mm, 2 mm, 3 mm, 4 mm, 5 mm, 6 mm, 7 mm, 8 mm, 9 mm, 1 cm, 2 cm, 10 cm, 20 cm, 30 cm, 40 cm, 50 cm, 1 m, 1.25 m, 1.5 m, 1.75 m, 5 m, or any other appropriate thickness. Correspondingly, thickness of the blanket layer is less than approximately 10 m, 5 m, 1.75 m, 1.5 m, 1.25 m, 1 m, 50 cm, 40 cm, 30 cm, 20 cm, 10 cm, 2 cm, 1 cm, 9 mm, 8 mm, 7 mm, 6 mm, 5 mm, 4 mm, 3 mm, 2 mm, or any other appropriate thickness. Combinations of the above are possible (e.g. the thickness of the blanket layer can be between approximately 1 mm and approximately 1.5 m). Other combinations are also possible.

In addition to the above, the electrodeposition process may be conducted in any number of different environments and with various electrodeposition baths. For example, in embodiments where the electrodeposition process is conducted at low pressures, a lower density blanket layer could be used. Additionally, in instances where the electrolyte bath is in the form of a slurry, the electrolyte bath has a correspondingly higher density and a higher density blanket layer could be used. Thus, the blanket layer density will vary according to the particular environment and electrolyte bath used. In one embodiment, the blanket layer density is greater than approximately 0.0001 g/cc, 0.001 g/cc, 0.01 g/cc, 0.1 g/cc, 0.5 g/cc, 1 g/cc, 2 g/cc, 3 g/cc, 4 g/cc, 5 g/cc, 10 g/cc, or any other appropriate density. Correspondingly, the blanket layer density is less than approximately 10 g/cc, 5 g/cc, 4 g/cc, 3 g/cc, 2 g/cc, 1 g/cc, 0.1 g/cc, 0.01 g/cc or any other appropriate density combinations of the above are possible (e.g. a blanket layer density between approximately 0.01 g/cc and approximately 2 g/cc). Other combinations of the above are also possible.

The currently disclosed electrolyte baths and methods may be used with any electrodeposition waveform. For example, the electrodeposition waveform may include any direct deposition, forward pulses, reverse pulses, pulses, combinations of the above, or any other appropriate electrodeposition processes. Further, transitions between the different portions of a waveform may either be done using step functions, or gradual transitions may be provided between the different portions of the waveform as the current disclosure is not limited in this fashion.

In one embodiment, the electrodeposition waveform includes forward and/or reverse pulses with a preselected current density. The current densities of the forward and reverse pulses may either be the same, the forward pulse may have a greater current density than the reverse pulse, or the reverse pulses may have a greater current density then the forward pulse. Specific ranges of possible current densities and pulse durations are provided below.

Depending on the embodiment, the current density of either of the pulses may be greater than about 10 mA/cm$^2$, 20 mA/cm$^2$, 30 mA/cm$^2$, 40 mA/cm$^2$, 50 mA/cm$^2$, 60 mA/cm$^2$, 70 mA/cm$^2$, 80 mA/cm$^2$, 90 mA/cm$^2$, 100 mA/cm$^2$, 150 mA/cm$^2$, 200 mA/cm$^2$, 250 mA/cm$^2$, 300 mA/cm$^2$, 350 mA/cm$^2$, 400 and mA/cm$^2$, 450 mA/cm$^2$, 500 mA/cm$^2$, 600 mA/cm$^2$, 700 mA/cm$^2$, 800 mA/cm$^2$, 900 mA/cm$^2$, 1000 mA/cm$^2$, 1200 mA/cm$^2$, 1400 mA/cm$^2$, 1600 mA/cm$^2$, 1800 mA/cm$^2$, or any other appropriate current density. Correspondingly, the current density of either of the pulses may be less than about 2000 mA/cm$^2$, 1800 mA/cm$^2$, 1600 mA/cm$^2$, 1400 mA/cm$^2$, 1200 mA/cm$^2$, 1000 mA/cm$^2$, 900 mA/cm$^2$, 800 mA/cm$^2$, 700 and mA/cm$^2$, 600 mA/cm$^2$, 500 mA/cm$^2$, 450 mA/cm$^2$, 400 mA/cm$^2$, 350 mA/cm$^2$, 300 mA/cm$^2$, 250 mA/cm$^2$, 200 mA/cm$^2$, 150 mA/cm$^2$, 100 mA/cm$^2$, or any other appropriate current density. Combinations of the above upper and lower ranges of current densities are possible (e.g. a current density between about 20 mA/cm$^2$ and 600 mA/cm$^2$). Other combinations are also possible.

In another related embodiment, the electrodeposition waveform may include forward, reverse pulses, and/or pauses with preselected durations. In embodiments including both reverse and forward pulses, the forward pulse durations and reverse pulse durations may be the same, the forward pulse duration may be greater than the reverse pulse duration, or the reverse pulse duration may be greater than the forward pulse duration. Additionally, in embodiments including one or more pauses between pulses, the pauses may be greater than, less than, or equal to the durations of the pulses. Appropriate durations for the forward pulses, reverse pulses, and/or pauses may be greater than about 5 ms, 10 ms, 15 ms, 20 ms, 25 ms, 30 ms, 35 ms, 40 ms, 45 ms, 50 ms, 60 ms, 70 ms, 80 ms, 90 ms, 100 ms, 200 ms, 300 ms, or any other appropriate duration. Correspondingly, appropriate durations for the fork pulses, reverse pulses, and/or pulses may be less than about 1 s, 500 ms, 400 ms, 300 ms, 200 ms, 100 ms, 90 ms, 80 ms, 70 ms, 60 ms, 50 ms, 45 ms, 40 ms, 35 ms, 30 ms, 25 ms, 20 ms, or any other appropriate duration. Combinations of the above upper and lower ranges of the durations are possible (e.g. a forward pulse duration between about 10 ms and 70 ms as well as a reverse pulse duration between about 5 ms and 60 ms). Other combinations are also possible.

In addition to electrodeposition of coatings, the current disclosure is applicable to electroforming techniques as described below regarding FIGS. 7 and 8. FIG. 7 depicts net shape forming of a part using a reactor 300 containing an electrolyte bath 302. An anode 304 and cathode 306 are immersed in the electrolyte bath. The cathode 306 includes an electrically coupled mandrel 308. The mandrel is made of a conductive material that may be separated from a subsequently electroformed part 310. In some embodiments the conductive material is a conductive wax or polymer that is subsequently removed, a metal that may be preferentially etched away, and/or a conductive material that does not form a strong bond with the deposited metal alloy permitting the electroformed part to be delaminated from the mandrel. In yet another embodiment, mandrel 308, of FIG. 7, is a cylinder that is rotated with respect to the anode 304. Depending on the final part to be produced the cylinder may be hollow or solid. By rotating the cylindrical mandrel, a rod is plated onto the exterior surface of the mandrel. If desired, the interior mandrel is subsequently etched away, or removed in any other appropriate fashion, to leave a free-standing rod made from the electrodeposited material. While a cylindrical mandrel has been disclosed, any desired shape could be used in place of a cylinder including, but not limited to, mandrels with square, rectangular, pentagon, star, or any other desired cross sectional shape. FIG. 8 also depicts a reactor 300 containing an electrolyte bath 302. An anode 312 is similarly immersed in the ionic liquid electrolyte 302. However, in the depicted embodiment the anode is shaped to conform to the shape of the corresponding cathode (e.g. rotating cathode drum 314). As material is electrodeposited onto the rotating cathode drum 314 a continuous electroformed sheet 316 is formed on and delaminated from the rotating cathode drum. While specific electrodeposition arrangements and final parts are disclosed herein, any number of electrodeposition arrangements can be used with the currently disclosed chemistries, methods, and systems. Consequently, the current disclosure is not limited to only the specific electrodeposition arrangements described herein.

In some embodiments, the cathode, which functions as a substrate for the electrodeposition process, becomes an integral part of the final electroformed part. In such an embodiment, the cathode functions as a substrate for a composite. For example, in one embodiment, the aluminum or metallic alloy (e.g., aluminum alloy) is electrodeposited onto one or more sides of a cathode to form a layered composite comprising the cathode and the electrodeposited metallic alloy layers deposited there on. In other embodiments, the cathode is substantially encapsulated within the electrodeposited metallic alloy with the cathode acting as a substrate that is incorporated into the final electroformed composite part. In certain instances, the above noted composites include a proportion of the electrodeposited metal alloy that is less than, approximately equal to, or greater than the proportion of substrate material provided by the cathode. It should be understood that the substrate incorporated into the composite can include any number of different materials including, but not limited to, metals, metallized plastics, and/or metallized ceramics.

In some embodiments, it is desirable to vary the composition and/or microstructure of the electrodeposited metallic alloy in one or more subsequently deposited layers to vary the material properties from the component interior to the component exterior. Alternatively, the composition of the electrodeposited metallic alloy can be continuously varied throughout the layer thickness. The composition of the electrodeposited metallic alloy layer(s) may be varied by controlling the relative concentrations of the main alloying element and the other alloying elements within the electrolyte bath. In various embodiments, the composition is controlled by varying the polarization of the anode in the system and/or concentrations of metallic salts in the electrolyte bath during the electrodeposition process. Alternatively, the component can be moved between various electrodeposition baths having different compositions to deposit the various layers with different compositions and/or microstructures. It should be noted, that in some instances the subsequently electrodeposited layers could be different metal/metal alloy systems.

In addition to varying the composition and/or microstructure of the electrodeposited metallic alloy by adjusting the electrolyte bath composition, the microstructure of the electrodeposited metal alloy may also be varied by controlling the deposition temperature, electrode polarizations, flow parameters, and other applicable processing parameters. Examples of such microstructural control is disclosed in copending U.S. patent application Ser. No. 12/579,062, the entirety of which is incorporated herein by reference. Such an embodiment incorporating composition and/or microstructure control may permit the properties of an electrodeposited material to vary from the interior to the exterior of the deposited layers to provide desired material characteristics. For example, without wishing to be bound by theory, in one embodiment, the interior portion of a material includes a composition and/or microstructure with a lower hardness and tensile strength as compared to an exterior portion of the material which includes a composition and/or microstructure with a higher hardness and tensile strength. Without wishing to be bound by theory, such an embodiment may be used to provide increased wear resistance for a component.

Depending on the embodiment, the coloration of the electrodeposited layer may be varied from white (e.g. bare aluminum) to black. Additionally, the brightness of the electrodeposited layer may be varied from a bright to a matte finish. Brightness and coloration can be controlled by varying the bath composition, i.e. the Mn and/or additive content, the bath temperature, and the pulse parameters of the applied current waveform (including current densities and pulse duration of the various pulses in the waveform). The above parameters may be controlled either individually, or in combination, to vary the color and brightness of the resulting electrodeposited layer.

Anode passivation may occur due to any number of reasons including high rate deposition. Without wishing to be bound by theory, anode passivation may compromise the anode performance consequently affecting the concentration of the metal ion species in the electrolyte bath corresponding to the anode. Thus, it is desirable to size the anode to cathode surface area ratio to avoid anode passivation at higher deposition rates. In addition to varying the anode to cathode ratio, anode passivation may be delayed by increasing the flow of ionic liquid electrolyte across the anode surface. Thus, anode passivation may be delayed through the use of flow control and/or variation of the anode to cathode surface area ratio. In one embodiment, the anode to cathode surface area ratio is greater than approximately 0.1, 1, 10, 20, 30, 40, 50, 60, 70, 80, 90, 100, 200, 400, 600, 800, or any other appropriate ratio. Further, the anode to cathode surface area ratio may be less than approximately 1000, 800, 600, 400, 200, 100, 90, 80, 70, 60, 50, 40, 30, 20, 10, 1, or any other appropriate ratio. Combinations of the above-referenced ranges are possible (e.g., the anode to cathode surface area ratio may be between approximately 0.1 to approximately 1000). It should be understood, that adjusting the deposition rate will affect the anode to cathode surface area ratio to avoid anode passivation. Therefore, the appropriate anode to cathode surface area ratio is selected for the desired electrodeposition process. Further, anode to cathode surface area ratios greater than needed to limit anode passivation can also be used as the current disclosure is not limited in this fashion.

In one embodiment, the anode includes high surface area electroactive materials to reduce the required anode volume for larger anode to cathode size ratios. For example, the anodes may include a plurality of pellets and/or an open cell foam to increase the available electroactive surface area. In embodiments using pellets for the anode active material, the shape of the anode is maintained through the use of an anode bag as discussed above with regards to the disclosed anode bags shown in FIGS. 5A and 5B. In such an embodiment, the individual pellets may be electrically coupled to one another via surface contact to surrounding neighbors. Alternatively, in some instances, the pellets may undergo a partial sintering process and/or include an electrically conductive binder to ensure electrical coupling between the various pellets in the anode while maintaining an open cell porous anode structure permitting the electrolyte to access the increased surface area of the anode.

Figure 9A:
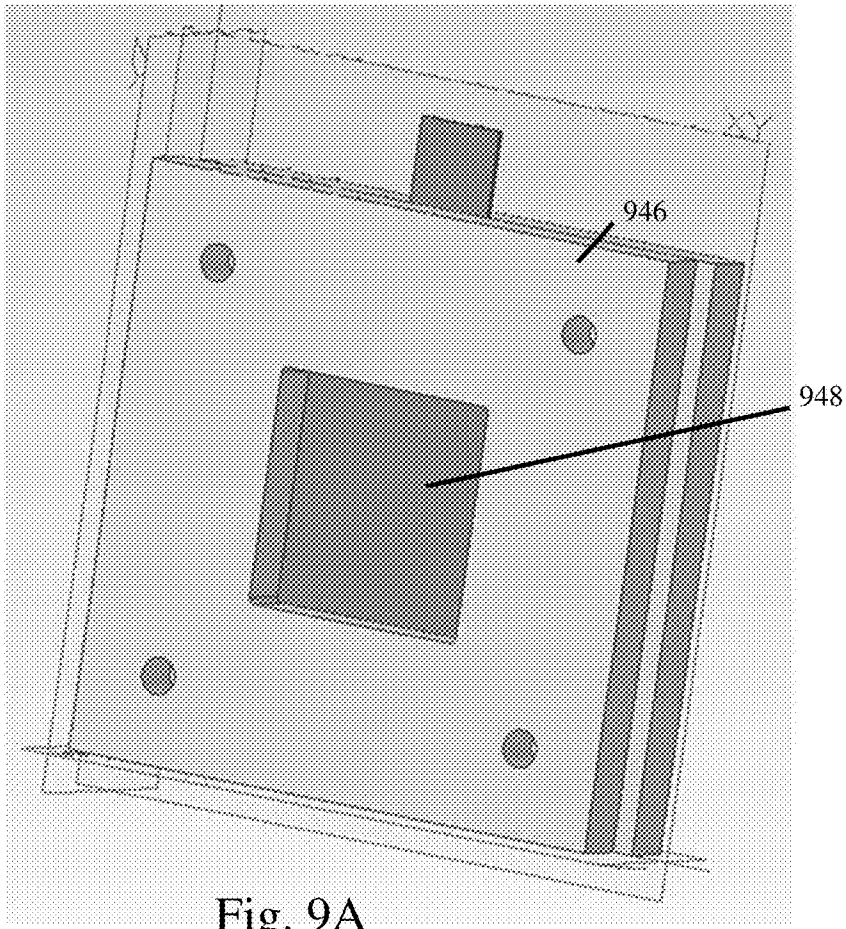
FIG. 9A depicts a shield assembly for shielding the edges of a substrate.

In addition to controlling the composition and rate of deposition, in many cases it is desirable to control the thickness and uniformity of the electrodeposited metal alloy on a substrate surface. For instance, and without wishing to bound by theory, corners and edges may concentrate the electric field lines during an electrodeposition process (i.e. the corners and edges may constitute high current density regions). Thus, deposition may preferentially occur in these regions, resulting in increased deposit thickness at the corners and edges of a workpiece. These effects can be reduced or eliminated through the use of shielding that partially limits deposition in these areas. In such an embodiment, a shielding fixture may be used to re-direct the electric field lines away from the edges and corners. Thus, deposition of the electrodeposited material may be at least partially prevented in the shielded portions of the substrate. In another embodiment, it may also be desirable to partially, or completely limit deposition in another region of a substrate for design purposes using a shielding fixture, or other arrangement, that is capable of masking the substrate. However, many of the conventional shielding techniques and equipment used for aqueous based electrolyte electrodeposition systems are incompatible with the corrosive ionic liquids discussed herein due to material incompatibilities. Consequently, methods and materials for shielding substrates for an electrodeposition process in an ionic liquid based electrolyte bath were developed. FIG. 9A illustrates a conceptual embodiment of a shield 946 placed on a substrate 948. In the depicted embodiment, a non-conductive frame corresponding to the shield 946 is placed in front of the substrate to reduce electric field lines at the edges and corners of the substrate.

In one embodiment, a material that is compatible with the ionic liquids, salts, and additives is used to fabricate a shield or mask as noted above. Further, the materials may be porous, or non-porous, to control the deposition of material through, or around, the provided masking or shielding. As noted previously, nonlimiting examples of compatible materials include polytetrafluoroethylene, perfluoroalkoxy, fluorinated ethylene propylene, glass, alumina, quartz, silicon carbide, stainless steel, titanium alloys, para-aramid polymers, thiolene, nickel alloys (e.g. nickel-chromium-iron alloys and nickel superalloys), zirconium alloys, refractory metals, epoxy, and acrylic. Without wishing to be bound by theory, when using a material that is nonconductive, the metallic alloy will not be deposited onto the material shielding it. However, embodiments are envisioned in which a conductive material is used to construct the shield. In such an embodiment, the metallic alloy would be deposited onto the shield material and the unshielded portion of the substrate.

Figure 9B:
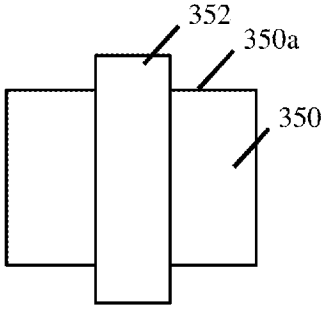
FIG. 9B-9D depict shielding a substrate with a material adjacent to the deposition surface.

In one embodiment, masking or shielding a substrate includes the use of a compressive wrapping of a compatible material such as a polytetrafluoroethylene tape wrapped around the deposition surface and associated anode. However, it should be understood that any appropriate material might be used including, but not limited to, ceramic tapes, other compatible polymer tapes, Such an embodiment is shown in FIGS. 9B-9D in which a portion of deposition surface 350*a* is shielded by a compressive wrapping 352 prior to deposition of the electrodeposited metal alloy 354. After the electrodeposition process is completed, the compressive wrapping 352 is removed exposing the shielded portion of the substrate 350. The compressive wrapping may intrinsically have compressive properties, or it may be wrapped or fixed in place such that it is positioned adjacent to the deposition surface.

Figure 9E:
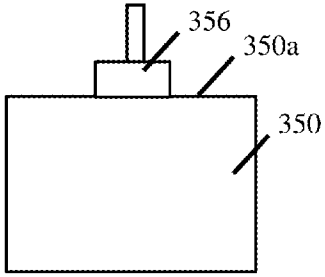
FIG. 9E-9G depict shielding a substrate with a fixture positioning a material adjacent to the deposition surface.
Figure 9H:
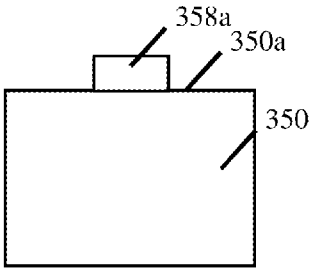
FIG. 9H-9J depict shielding a substrate with a resin applied and cured on the deposition surface.
Figure 9C:
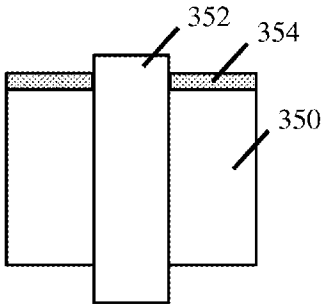
Figure 9F:
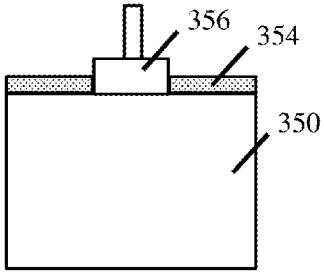
Figure 9I:
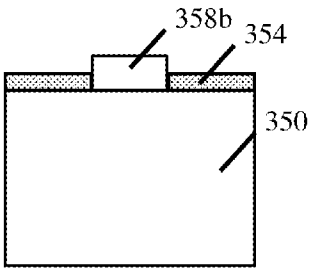
Figure 9D:
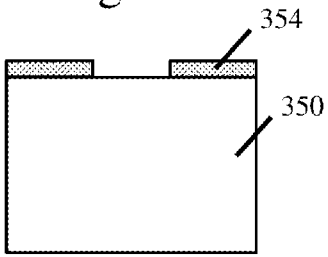
Figure 9G:
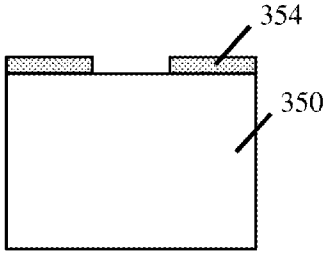

In another embodiment, as shown in FIGS. 9E-9G, the material used to mask or shield the substrate is positioned adjacent to the deposition surface 350*a* by a fixture 356 prior to electrodeposition of the electrodeposited metal alloy 354. Similar to the above, after the electrodeposition process is completed, the fixture 356 and the associated shielding material is removed exposing the shielded portion of the substrate 350.

Figure 9J:
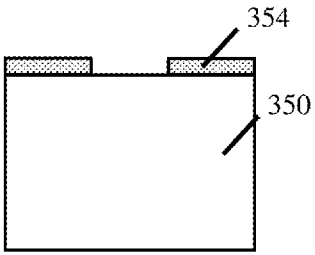

In yet another embodiment, as shown in FIGS. 9H-9J, a polymeric material that is compatible with the ionic liquid is selected. A resin of the polymeric material 358*a* is applied to the deposition surface 350. Similar to the above embodiments, the resin covers at least a portion of the deposition surface and at least a portion of deposition surface is uncovered. The resin is subsequently cured to form the polymeric material 358*b* that is compatible with the ionic liquid electrolyte. The resin is cured using any appropriate technique including, but not limited to, heating the resin, exposing the resin to electromagnetic radiation, exposing the resin to an electron beam, and/or mixing the resin with a hardener. After curing, the electrodeposition process is carried out to form electrodeposited metal alloy 354. Once electrodeposition is complete, the polymeric material 358 is removed to expose the shielded portion of the substrate 350 using any appropriate technique including, but not limited to, delamination, abrasion, decomposition, and/or dissolution. In such an embodiment, the resin may be a resin of polytetrafluoroethylene, perfluoroalkoxy, and fluorinated ethylene propylene, a para-aramid polymer, thiolene, epoxy, acrylic, or any other appropriate polymer. In another embodiment, a wax may be used in place of a polymer in which case, the wax could be applied through the use of heat and/or pressure instead of a polymerization process. It should be understood that other resins and materials could be selected as the currently disclosed masking and shielding methods are not limited in this fashion. Further, the selected material may be substantially impermeable, or permeable, to enable partial shielding, or masking, of the substrate.

In some embodiments, the aluminum or aluminum alloy is subjected to at least one post-treatment step. Non-limiting examples of post-treatment steps include anodizing, chromating, passivation dips, grinding, polishing, welding, adhesive bonding, elecro-joining, heat treatment, painting, and electropainting. For example, without wishing to be bound by theory, heat treating of the components may be used to provide better adhesion between the substrate and electrodeposited layers, alter the microstructure and resulting properties of the electrodeposited material, and/or relieve stress in the electrodeposited material. In some embodiments, post-treatment may alternatively, or in addition to the above, comprise forming at least one second material on the aluminum or aluminum alloy.

In a related embodiment, it is desirable to provide an aluminum coating, or other appropriate metal coating, on top of an electrodeposited metal or other appropriate substrate including, but not limited to, commercially available metals or any electrically conductive surfaces. The aluminum coating may be an electrodeposited aluminum coating though any appropriate coating could be used including, but not limited to, dips and electrodeposited layers with microcrystalline or nanocrystalline grain sizes. For example, in one embodiment, an aluminum alloy such as aluminum manganese is coated with a pure aluminum coating. Without wishing to be bound by theory, such a coating may improve the properties and appearance of the resulting component. For example, an exterior coating of aluminum subjected to a post treatment anodization process may exhibit a more desirable surface appearance as compared to an alumina manganese alloy that has undergone a similar post treatment anodization process. In some embodiments, an exterior coating of aluminum may improve the corrosion resistance and chemical resistance of the resulting component to certain corrosive and/or reactive environments as compared to the underlying coated material. For example, similar to the 2000 and 7000 series of aluminum which comes in aluminum clad sheets, the pure aluminum may act as a sacrificial coating to protect the underlying material. In addition to the above, structures incorporating multiple layers of various different electrodeposited metals, and other types of coatings, may be provided to tailor the performance of the resulting structure and/or provide novel composite materials. The coatings may vary in thickness. Depending on the embodiment, the thickness of the layers may be greater than approximately 0.1 μm, 0.2 μm, 0.3 μm, 0.4 μm, 0.5 μm, 0.6 μm, 0.7 μm, 0.8 μm, 0.9 μm, 1 μm, 2 μm, 3 μm, 4 μm, 5 μm, 10 μm, 20 μm, 30 μm, 40 μm, 50 μm, or any other appropriate thickness. Correspondingly, the thickness of the layers may be less than approximately 100 μm, 90 μm, 80 μm, 70 μm, 60 μm, 50 μm, or any other appropriate thickness. Combinations of the above are possible (e.g. between approximately 0.1 μm and approximately 100 μm or between approximately 10 μm and approximately 50 μm). Other combinations are also possible.

Depending on the desired application of the electrodeposited metal alloy, in some embodiments, it is desirable to alter the properties of the electrodeposited metal layer itself. For example, increased wear, strength, and/or corrosion properties may be desired in the electrodeposited metal layer. Therefore, in some embodiments electrodeposition of the metal alloy includes co-deposition of particulates, fibers, carbide, and/or other materials with the electrodeposited metal alloy to provide increased strength and/or wear resistance in the electrodeposited metal layer.

In one embodiment, electrodeposition is conducted at low temperatures. Without wishing to be bound by theory, such an embodiment may be useful for modifying the microstructure of the electrodeposited alloy. To enable low temperature electrodeposition, the electrodeposition system includes an active cooling system in place of, or in addition to, the heater disposed within the electrolyte bath described above. Similar to the use of a heater, the active cooling system maintains the electrolyte bath within a preselected temperature range. Possible embodiments of the active cooling system include, but are not limited to, parallel flow heat exchangers, counter flow heat exchangers, immersion chillers, or any other appropriate device or configuration capable of cooling the electrolyte bath. Since the chiller and/or heating system may be in direct contact with the electrolyte bath in some embodiments, the chiller and/or heating system is made from, or coated with, a material that is substantially compatible with the electrolyte bath. In some cases, the electrodeposition occurs at a temperature at about room temperature, or less than room temperature, or less than about 25° C., or less than about 20° C., or less than about 15° C., or less than about 10° C., or less than about 5° C., or less than about 0° C., or less than about −10° C., or less than about −20° C., or less than about −30° C., or less than about −40° C., or less. In some cases, the electrodeposition is carried out under pressure and/or in a sealed chamber. It should be understood that a lower bound to the electrodeposition process is the freezing point of the electrolyte bath.

In an alternative embodiment, the electrodeposition is conducted at high temperatures. To facilitate electrodeposition at high temperatures the use of high pressures and/or a sealed electrodeposition chamber may be implemented. Without wishing to be bound by theory, it may be desirable to suppress boiling of the electrolyte bath during high temperature electrodeposition. Consequently, in such an embodiment, the operating pressure is selected to suppress boiling of the electrolyte bath at the desired elevated operating temperature. Alternatively, the cosolvent used in the electrolyte bath may be selected to provide a boiling point greater than the desired elevated operating temperature. Thus, boiling of the electrolyte bath during operation is substantially avoided. As described above with the general system, the heater immersed in the electrolyte bath is used to maintain the temperature of the electrolyte bath within a preselected temperature range of the preselected high temperature operating point. In some cases, the electrodeposition occurs at a temperature above room temperature, greater than about 25° C., greater than about 40° C., greater than about 50° C., greater than about 60° C., greater than about 70° C., greater than about 80° C., greater than about 90° C., greater than about 100° C., greater than about 120° C., greater than about 140° C., greater than about 160° C., greater than about 180° C., or greater than about 200° C. In some cases, the electrodeposition is carried out under pressure and/or in a sealed chamber. It should be understood that an upper bound to the electrodeposition process is the boiling point of the electrolyte bath.

In embodiments where a volatile cosolvent is used, the cosolvent evaporates from the electrolyte bath during the electrodeposition process. Thus, it may be desirable to recover the evaporated cosolvent to reduce either cosolvent consumption and/or emissions. For example, in one embodiment, a fume hood, glove box or other structure associated with an electrolyte bath is operatively connected with a condenser adapted and configured to condense and recover the vaporized cosolvent. The recovered cosolvent is subsequently returned to the electrolyte bath, or it can be separately stored for subsequent disposal.

In yet another embodiment, it may be desirable to improve mixing and/or agitation of the electrolyte bath, remove unwanted contaminants from the electrolyte bath, and/or modify the electrolyte bath chemistry. Without wishing to be bound by theory, various gases bubbled through the electrolyte bath may be used to provide the above noted modifications of the electrolyte bath. For example, in one embodiment, an inert gas with regards to the ionic liquid, such as those noted above, is bubbled through the electrolyte bath. The flow rate and dispersion of the gas is selected to improve mixing of the electrolyte bath while not inhibiting the electrodeposition process. In other embodiments, the gas is selected to act as a scavenging gas to remove contaminants from the electrolyte bath. In one nonlimiting example, phosgene can be used to convert oxychloroaluminate species which result from contamination by air and water. Without wishing to be bound by theory, phosgene converts oxychloroaluminate species into desired chloroaluminate species present normally in the electrolyte and thus effectively removing oxide contamination. Also, in some embodiments, inert gases such as argon, nitrogen and carbon dioxide can be used to drive off hydrogen chloride gas, which forms when the electrolyte bath is contaminated with water.

Ionic Liquid Electrolyte Maintenance and Electrodeposition Methods

To provide uniform properties for the electrodeposited metal alloy throughout the electrodeposition process, it is desirable to maintain the electrolyte bath operating parameters within preselected thresholds. In order to maintain the electrolyte bath within the desired preselected thresholds, electrolyte maintenance procedures may be implemented including, but not limited to: monitoring and replenishment of additives, salts, cosolvents, ion concentrations, and other appropriate components; temperature control; monitoring and adjustment of filtration and pump performance; and other operating parameters as would be apparent to one of ordinary skill in the art.

Figure 10A:
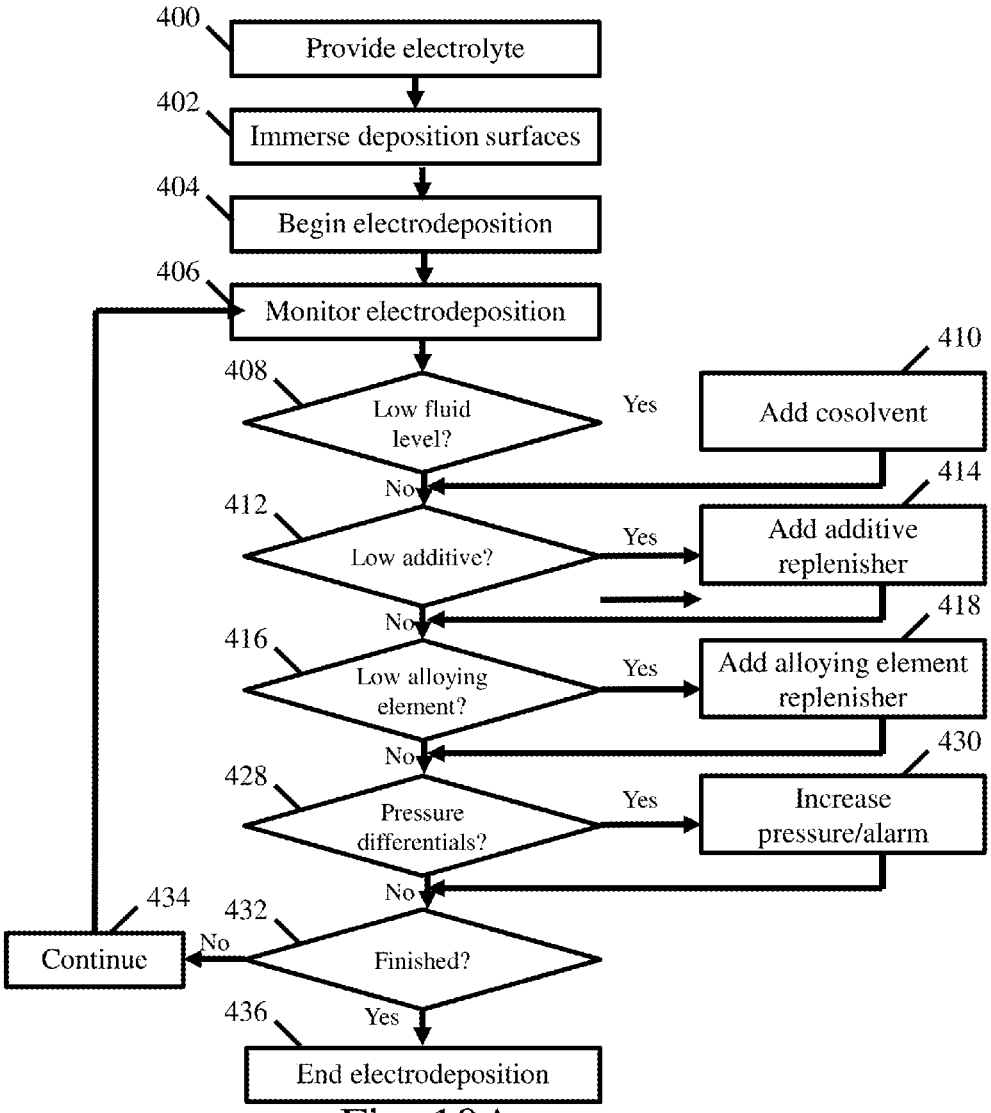
FIG. 10A is an exemplary process flow diagram of an electrodeposition process with electrolyte monitoring and maintenance.
Figure 10B:
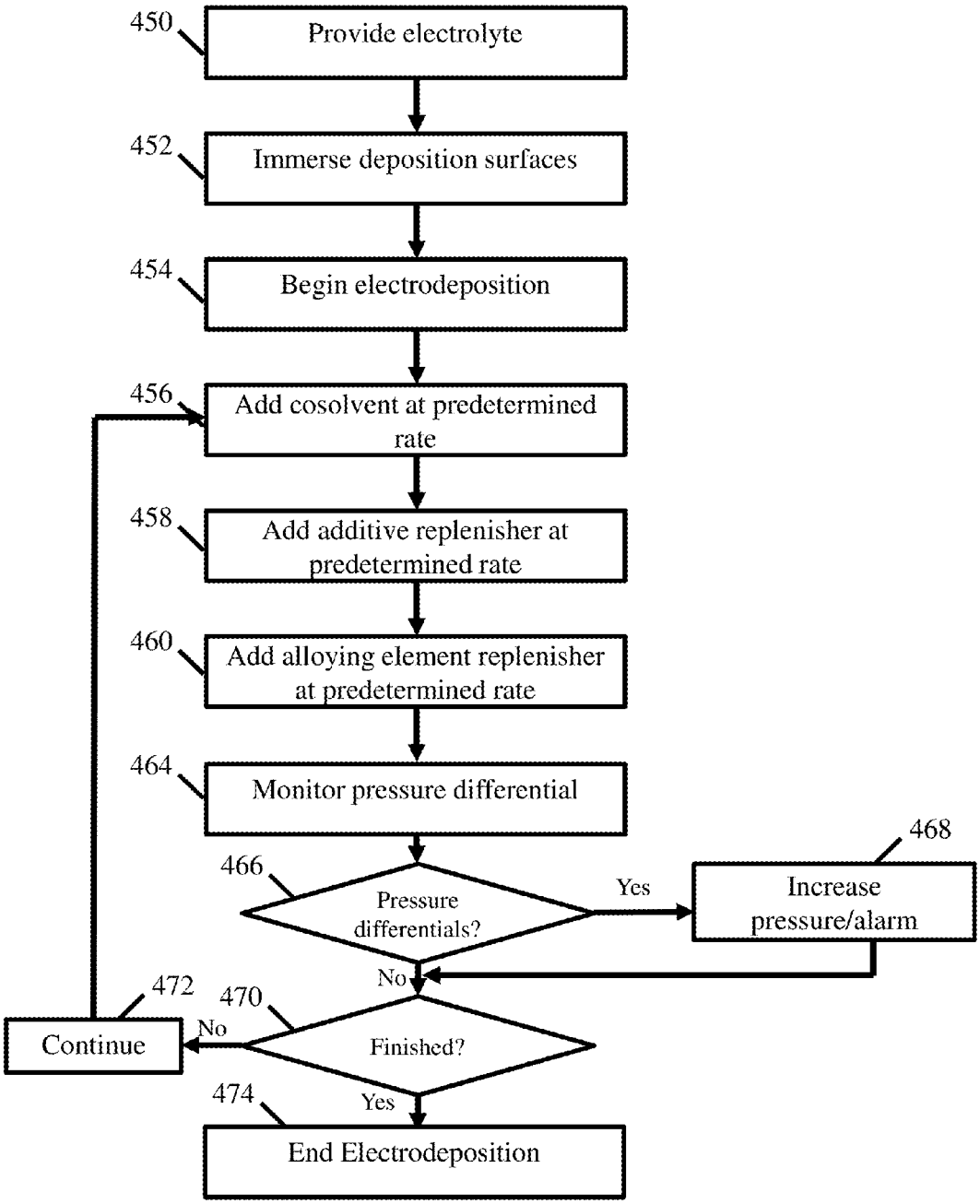
FIG. 10B is an exemplary process flow diagram of an electrodeposition process with predetermined rates of electrolyte maintenance.

FIGS. 10A and 10B depict two different methods for maintaining a liquid ionic electrolyte bath. While specific methods and monitoring techniques are disclosed below, it should be understood that any number of additional techniques could be employed in maintaining the ionic liquid electrolyte bath without departing from the spirit of the current disclosure. Furthermore, embodiments of the current bath maintenance methods could incorporate any combination of the methods disclosed with regards to FIGS. 10A and 10B. In addition, embodiments of the bath maintenance methods disclosed herein may incorporate all of, or only a subset of the disclosed methods as the current disclosure is not limited in this fashion.

Turning now to FIG. 10A, an electrolyte bath containing the appropriate amounts of salts, additives, ions, and other constituents is provided at 400. After providing the electrolyte bath, the deposition surfaces present on the cathode(s) are prepared and subsequently immersed in the electrolyte bath at 402. Once the system has been set up, the electrodeposition process begins at 404. Depending on the duration of the electrodeposition process and/or the amount of metallic alloys to be deposited, monitoring and maintenance of the electrolyte bath during the electrodeposition process is employed, see 406.

Depending upon the specific cosolvent used and the desired operating temperature, the cosolvent present within the ionic liquid electrolyte may evaporate due to a high vapor pressure at the selected operating temperature and pressure. Thus, over time the concentration of cosolvent within the ionic liquid electrolyte may be reduced. In certain instances, this loss of cosolvent is sensed by monitoring the ionic liquid electrolyte fluid level within the reactor, see 408, though other sensing methods, including compositional analysis, are also envisioned. When a sensed fluid level, or other parameter, is lower than a preset threshold indicating a low cosolvent composition, an additional amount of cosolvent is added to the ionic liquid electrolyte as indicated at 410. In certain embodiments, the preset thresholds may correspond to a cosolvent concentration within the ionic liquid electrolyte less than approximately 45%, 40%, 35%, 30%, or any other appropriate concentration. The amount of cosolvent to be added to the ionic liquid electrolyte may be a predetermined amount or it may be determined from the sensed fluid level such that it substantially returns the cosolvent concentration to a predetermined concentration.

In addition to regulating cosolvent concentrations, additive and alloying element ionic species concentrations within the electrolyte bath are monitored as indicated in 412 and 416. The additive and alloying element ionic species concentrations may be monitored using any appropriate sensing technique, including those currently disclosed herein. Regardless of the specific technique used, when a sensed concentration of an additive or alloying element is below a preset threshold, a corresponding additive replenisher and/or an alloying element replenisher is added to the electrolyte bath to maintain the monitored additive and alloying element ionic species concentrations at their respective preselected concentrations as indicated at 414 and 418.

The additive replenisher and alloying element replenisher may be embodied in any number of ways. For example, a replenisher may simply be the electrolyte additive or a salt containing the alloying element that is added to the electrolyte bath and allowed to dissolve therein. However, in such an embodiment, it might be necessary to delay the electrodeposition process while the material dissolves into the electrolyte bath. Alternatively, in some embodiments, the replenisher is a replenishing solution containing the desired additive, salt, ionic species, or other material dissolved therein. Consequently, since the materials are already dissolved in the replenishing solutions, the various replenishing solutions can be added directly to the electrolyte bath to replenish the additive and/or alloying element ionic species without needing to halt the electrodeposition process while the material dissolves. In one such embodiment, the replenishing solution is chemically similar to the electrolyte bath and contains the additive, salt, ionic species and/or other appropriate material dissolved therein. Further, to reduce the amount of replenishing solution added to the electrolyte bath, the replenishing solution can advantageously include a concentration of the additive, salt, and/or other appropriate material that is greater than the concentration within the electrolyte bath. In some instances, the replenishing solution is a saturated, or supersaturated solution, containing the additive, salt, ionic species, and/or other appropriate material. While, separate replenishing solutions for the additive and alloying element may be provided, the replenishing solution can include both an additive replenisher and an alloying element replenisher. Further, the additive and alloying element ionic species concentrations within the combined replenishing solution may have a ratio substantially corresponding to an expected relative consumption rate of the additive and alloying element ionic species during the electrodeposition process.

As an alternative to using an alloying element replenishing solution as described above, a secondary anode corresponding to the alloying element may be used. For example, when a sensed concentration of a metal ionic species corresponding to the alloying element falls below a preset threshold, the secondary anode polarization is adjusted to increase the concentration of the metal ionic species of the alloying element in the electrolyte bath. In addition, when a sensed concentration of the metal ionic species of the alloying element rises above a separate preset threshold, the secondary anode polarization is adjusted to decrease the concentration of the metal ionic species of the alloying element in the electrolyte bath. Similar adjustments can be made for the concentration of the primary metal ionic species within the electrolyte bath corresponding to the primary anode by varying the polarization of the primary anode. In addition to adjusting the relative polarizations of the primary and secondary anodes, the size of the secondary anode relative to the primary anode may be selected to control the relative concentration of the separate alloying elements in the ionic liquid electrolyte without requiring excessive polarization of either anode that might lead to the introduction of other undesired ionic species into the electrolyte bath.

As indicated at 428, pressure differentials within the fluid flow components such as the filter, bypass, pump, fluid distribution system, and associated plumbing are monitored. Pressure differentials that exceed preset thresholds for the various components may indicate a blockage. Due to the flow sensitivity of electrodeposition processes in ionic liquid based electrolytes, it is desirable to either compensate for the fluid flow loss associated with a detected blockage by increasing the applied pressure and/or initiate an alarm to notify an operator of the condition so that it can be remedied, see 430. In order to compensate for the fluid flow loss, the pressure applied to the system by the pump may be increased in proportion to the detected pressure differential.

As indicated at 432 and 434, the various conditions and parameters described above with regards to steps 408-430 are regularly and/or continuously monitored and maintained until the electrodeposition process is ended, see 436. Further, in some embodiments the electrolyte bath is maintained even when electrodeposition is not being performed. Thus, the electrolyte bath can be ready for electrodeposition at any time without the need to either replace or replenish the electrolyte bath prior to starting an electrodeposition process. It should be noted that the above disclosed monitoring and maintenance methods may be fully automated, or they may be performed manually, as the current disclosure is not limited in this fashion. In addition, the disclosed monitoring and maintenance methods could include a combination of automated and manually performed steps. In some cases, an automated system comprises components configured and arranged to replenish the aluminum ionic species, the second type of metal ionic species, the organic co-solvent, the ionic liquid, and/or the one or more additives. In some cases, the automated system comprises components configured and arranged to analyze one or more properties relating to the aluminum ionic species, the second type of metal ionic species, the organic co-solvent, the ionic liquid, and/or the one or more additives.

Another method for maintaining an electrolyte bath comprising an ionic liquid is disclosed in FIG. 10B. The disclosed method is similar to that presented in FIG. 10A in that an electrolyte bath is provided at 450 and a deposition surface corresponding to a cathode is immersed in the electrolyte bath at 452 prior to beginning the electrodeposition process at 454. However, instead of actively monitoring each parameter the electrolyte bath is maintained according to predetermined consumption rates and predetermined maintenance intervals for a given electrodeposition process.

In the current embodiment, cosolvent is added to the electrolyte bath at a predetermined rate at 456. The rate of cosolvent addition to the ionic liquid electrolyte substantially corresponds to the expected evaporation rate of the cosolvent for the given electrolyte bath surface area, operating pressure, and operating temperature.

In addition to maintaining the cosolvent concentration, additive and alloying element replenishers, as described above, are added to the electrolyte bath at a predetermined rate corresponding to the respective consumption rates for both at a given electrodeposition rate, see 458 and 460. In one embodiment, separate replenishers are used, or a combined replenisher with concentrations of both the additive and alloying element ionic species substantially corresponding to the proportion of their respective consumption rates is used. In addition, as described above the replenishers include at least one of an additive, a metal ionic species, another appropriate material, or a combination of the above.

Similar to the embodiment described above in regards to FIG. 10B, the pressure differentials within the fluid flow components are monitored to detect any blockages therein and the system may either increase the applied pressure to maintain the flow of ionic liquid electrolyte and/or initiate an alarm, see 464-468. Further, the filter is replaced at preselected intervals.

The additions of cosolvents, replenishers, as well as monitoring of the pressure differentials, are continued until the electrodeposition process is ended as indicated in 470-474. Furthermore, the cosolvents and replenishers are either added at a continuous predetermined rate, or are added as periodic predetermined quantities at predetermined intervals, as the current disclosure is not limited in this fashion.

Through the use of the above disclosed ionic liquid electrolytes, additives, salts, systems, and methods, it is possible to perform high rate electrodeposition in electrolyte baths containing ionic liquids for various metallic and metallic alloy systems. For example, nano structured aluminum alloys having an average grain size less than approximately 1 μm, and especially nano structured aluminum manganese based alloys as disclosed in copending U.S. patent application Ser. No. 12/579,062, may be electrodeposited at rates greater than approximately 10 μm/hr, 20 μm/hr, 30 μm/hr, 40 μm/hr, 50 μm/hr, 60 μm/hr, 70 μm/hr, 80 μm/hr, 90 μm/hr, 100 μm/hr, 200 μm/hr, 300 μm/hr, 400 μm/hr, 500 μm/hr, 600 μm/hr, 700 μm/hr, 800 μm/hr, 900 μm/hr, or any other appropriate rate. Correspondingly, nano structured aluminum alloys may electrodeposited at rates that are less than approximately 1000 μm/hr, 900 μm/hr, 800 μm/hr, 700 μm/hr, 600 μm/hr, 500 μm/hr, 400 μm/hr, 300 μm/hr, 200 μm/hr, 100 μm/hr, or any other appropriate rate. Combinations of the above noted rates are possible (e.g. a nano structured aluminum based alloy could be electrodeposited at a rate between approximately 10 μm/hr to approximately 1000 μm/hr). Other combinations of the electrodeposition rates are also possible. While electrodeposition rates greater than 10 μm/hr and less than 1000 μm/hr are described above, the current disclosure is not limited to any specific electrodeposition rate. Instead, the chemistries, systems, and methods disclosed herein should be interpreted as being applicable to electrodeposition of materials at any rate including rates that are less than and greater than the above-noted range of electrodeposition rates. Further, it should be understood that the nano structured alloys referenced above have an average grain size less than approximately 1 μm and also include embodiments wherein the alloy is partially or substantially amorphous. Without wishing to be bound by theory, an amorphous material may be viewed as having an average grain size of approximately 0 μm.

In addition to high rate electrodeposition, the current disclosure enables electrodeposition of materials, including nano structured materials, on industrially relevant timescales for thicknesses ranging from thin coatings to structural members. For example, material may be electrodeposited in thicknesses greater than approximately 0.1 μm, 1 μm, 5 μm, 10 μm, 20 μm, 30 μm, 40 μm, 50 μm, 100 μm, 150 μm, 200 μm, 300 μm, 400 μm, 600 μm, 700 μm, 800 μm, 900 μm, 1 mm, 2 mm, 3 mm, 4 mm, 5 mm, 1 cm, 2 cm, 5 cm, or any other appropriate thickness. In addition, material may be electrodeposited in thicknesses less than approximately 20 cm, 15 cm, 10 cm, 5 cm, 2 cm, 1 cm, 5 mm, 4 mm, 3 mm, 2 mm, 1 mm, 900 μm, 800 μm, 700 μm, 600 μm, 500 μm, 400 μm, 300 μm, or any other appropriate thickness. Combinations of the above noted ranges are possible (e.g. an electrodeposited material may have a thickness between approximately 40 μm and 2 mm). Other combinations are also possible.

Depending on the particular processing parameters used, a nano structured electrodeposited material may exhibit enhanced ductility. For example, in comparison to a nano structured aluminum manganese alloy deposited using a direct current electrodeposition which typically exhibits ductility less than 5% and in some instances negligible ductility, an aluminum manganese alloy deposited using the currently disclosed electrolytes and deposition methods may exhibit a ductility greater than approximately 5%, 10%, 15%, 20%, 25%, 30%, 35%, 40% or any other appropriate ductility. The ductility of the aluminum manganese alloy deposited using the currently disclosed electrolytes and deposition methods may also exhibit a ductility less than approximately 40%, 35%, 30%, 25%, 20%, 15%, 10%, or any other appropriate ductility. Combinations of the above ranges are possible (e.g. a ductility between approximately 10% and 15%). Other combinations are also possible.

While any number of different alloy compositions may be used, in one embodiment, the electrodeposited metal alloy is a nano structured aluminum manganese alloy. For example, the alloy may have a manganese content greater than approximately 1 at.%, 2 at.%, 3 at.%, 4 at.%, 5 at.%, 6 at.%, 7 at.%, 8 at.%, 9 at.%, 10 at.%, 12 at.%, 13 at.%, 14 at.%, 15 at.%, or any other appropriate composition. Correspondingly, the manganese content may be less than approximately 20 at.%, 19 at.%, 18 at.%, 17 at.%, 16 at.%, 15 at.%, 14 at.%, 13 at.%, 12 at.%, 11 at.%, 10 at.%, 9 at.%, 8 at.%, 7 at.%, 6 at.%, 5 at.%, or any other appropriate composition. Combinations of the above are possible (e.g. an alloy composition including between 1 at.% manganese to approximately 20 at.% manganese or between approximately 5 at.% manganese to approximately 15 at.% manganese). Other combinations for the electrodeposited metallic alloy composition are also possible.

EXAMPLES

Material Testing

Due to the corrosive nature of the ionic liquid based electrolytes, testing was conducted to determine materials compatible with the ionic liquid, salts, and additives used in the currently disclosed electrodeposition processes. In addition to determining compatibility, wettability of the materials within the ionic liquid electrolyte was also evaluated to determine materials that are further suitable for use as membranes, separators, and other components within the electrodeposition system that might benefit from being wettable by the electrolyte bath. Material compatibility was tested by immersing a sample of known mass for each material into a known volume of ionic liquid electrolyte. The samples were immersed in the ionic liquid electrolyte for up to one month at room temperature. After the long-term immersion testing, the samples were evaluated for changes in their physical properties including their mass, volume, dimensions, color, and rigidity. Materials were evaluated as being either compatible, semi compatible, or not compatible with the electrolyte. While not appropriate for permanent use, the materials that were determined to be semi compatible with the electrolyte are suitable for use in or with the electrolyte for a predetermined amount prior to replacement. Without wishing to be bound by theory, in some instances, prolonged use of the semi compatible materials in the electrolyte may alter the electrolyte chemistry which may necessitate regenerating or replacing the electrolyte.

Material wettability was also evaluated qualitatively by placing a small quantity of electrolyte onto a surface comprising the material being tested. The surface was then visually evaluated to see if the electrolyte had beaded up or wetted the surface.

A summary of the testing results are presented below characterizing the compatibility and wettability of the various materials with respect to the ionic liquid electrolyte. While specific materials are listed, it is envisioned that other materials will be found to be compatible with ionic liquid based electrolytes. Therefore, the current disclosure should not be limited to only the materials tested below.

TABLE 1

| Material | Compatibility | Wettability |
|---|---|---|
| Polytetrafluoroethylene | Y | N |
| Perfluoroalkoxy | Y | N |
| Fluorinated Ethylene Propylene | Y | N |
| Borosilicate Glass | Y | Y |
| Glassy Carbon | N | — |
| Alumina | Y | — |
| Quartz | Y | — |
| Stainless Steel | S | Y |
| Polypropylene | S | — |
| Polyethylene | S | — |
| Ethylene Propylene Diene Monomer (M-class) Rubber | N | — |
| Kalrez/perfluoroelastomers | Y | N |
| Aluminum Alloys | S | Y |
| Para-Aramid Polymers | Y | Y |
| Thiolene | S | — |
| nickel-chromium-iron alloys | S | Y |
| nickel superalloys | S | Y |
| zirconium alloys | S | Y |
| refractory metals | S | Y |

In the above table, with regards to compatibility, a Y indicates that the material is compatible with the electrolyte, an N indicates that the material is incompatible with the electrolyte, and an S indicates that the material is semicompatible with the electrolyte. With regards to wettability, a Y indicates that the material is wettable by the electrolyte and an N indicates that the material is not wettable by the electrolyte. A hyphen in the above table indicates that the test was not performed for that material, and does not indicate whether or not the material is compatible with, or wettable by, the electrolyte.

Using the above table, materials for the components of the electrodeposition system may be selected. For example, in one embodiment, the structural components of the electrodeposition system are formed using at least one of polytetrafluoroethylene, perfluoroalkoxy, and fluorinated ethylene propylene. Further, the filters and anode bags are formed using a para-aramid polymer and Kalrez/perfluoroelastomers are used to form the seals in the system such as O-rings.

Blanket Layers

Figure 11:
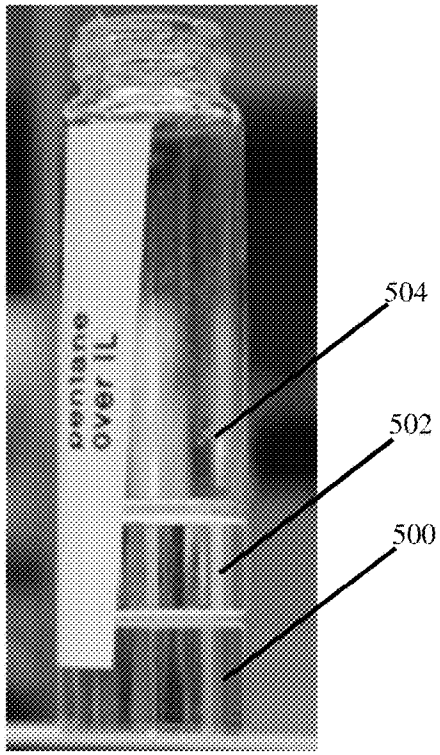
FIG. 11 is a picture of ionic liquid electrolyte covered with a blanket layer of pentane.

In addition to the use of carbon dioxide gas, nitrogen gas, and the various noble gases as a blanket layer, testing was conducted to evaluate an appropriate liquid blanket layer that would be less susceptible to turbulent mixing with the surrounding atmosphere. As depicted in FIG. 11, testing was conducted by placing the ionic liquid electrolyte 500 in a container. The liquid blanket layer 502 was placed into the same container. Due to the immiscibility and lighter density of the liquid blanket layer 502, it separated from the ionic liquid electrolyte and formed a barrier between the atmosphere 504 and ionic liquid electrolyte 500. To evaluate the effectiveness of the blanket layer, the container was left exposed to the atmosphere for several hours after which the ionic liquid electrolyte was evaluated to see if it had reacted with moisture from the atmosphere. Evaluation of the ionic liquid electrolyte is simplified due to the ionic liquid electrolyte turning brown from reaction with moisture in the atmosphere. While a simple visual observation was used, alternative electrochemical methods for evaluating the electrolyte could be used. For example, cyclic sweep voltammetry, plating efficiency, quality of plated components, and other appropriate techniques could be used to evaluate moisture contamination.

The blanket layer depicted in FIG. 11 corresponds to the testing of a pentane based blanket layer. After exposure to the atmosphere for several hours, no change in the ionic liquid electrolyte was observed. Consequently, pentane was determined to be an appropriate blanket layer for use with ionic liquid based electrolytes.

Conductivity of Ionic Liquid Electrolyte with Cosolvent

Figure 12:
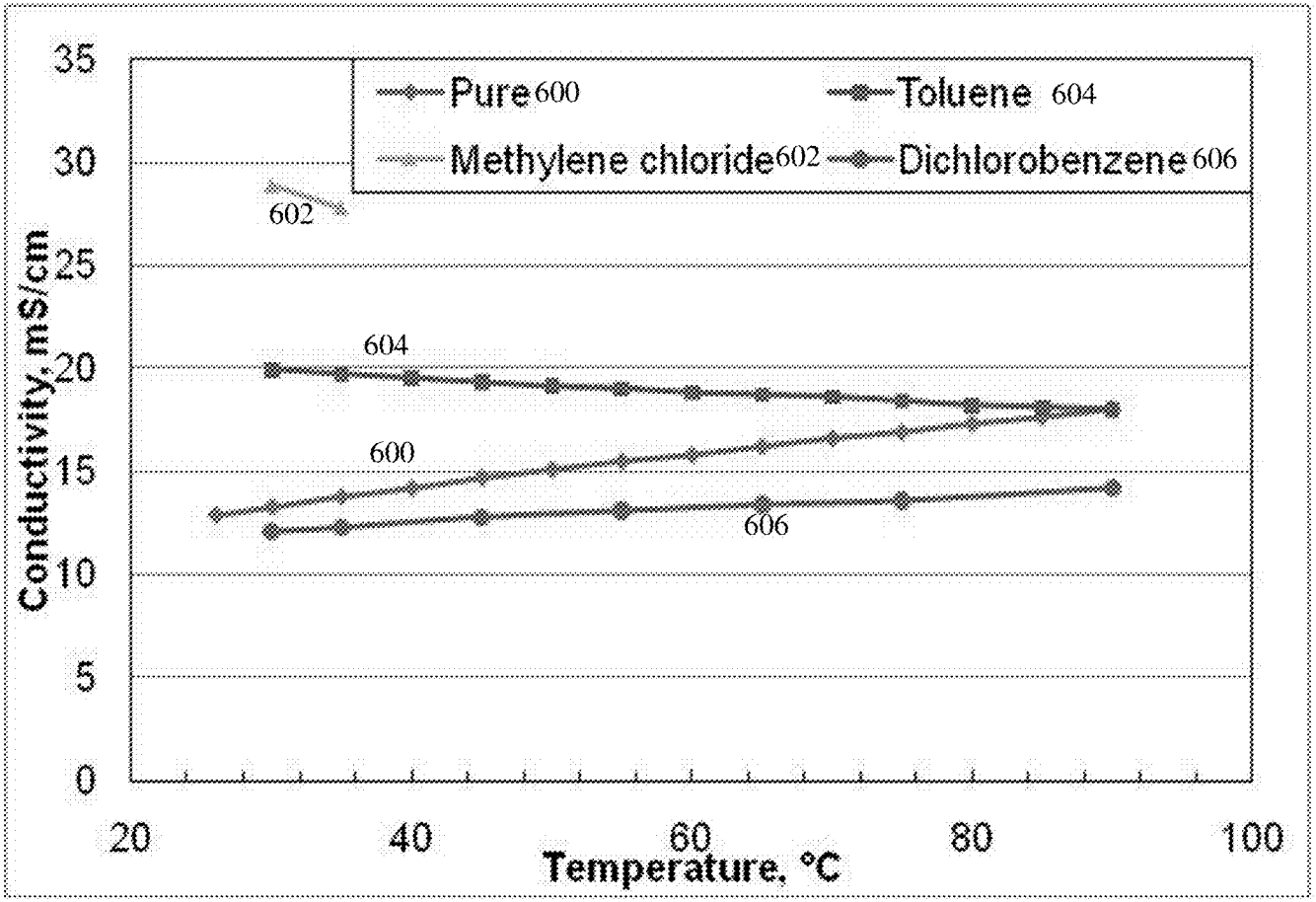
FIG. 12 is a graph of ionic liquid electrolyte conductivity for various temperatures and cosolvents.

It was observed that the viscosity and conductivity of the pure ionic liquid electrolyte limited high rate electrodeposition of materials. Consequently, various cosolvents were tested to evaluate their effect on the conductivity of the ionic liquid electrolyte. In addition, the temperature sensitivity of the conductivity for each resulting ionic liquid electrolyte containing the different cosolvents was evaluated. The results presented in FIG. 12 correspond to mixtures of 50 vol % ionic liquid with 50 vol % of the various cosolvents. The cosolvents that were tested include methylene chloride 602, toluene 604, and dichlorobenzene 606 as presented in the graph depicted in FIG. 12. The resulting conductivities of each ionic liquid electrolyte mixed with cosolvent versus temperature are compared to a pure ionic liquid based electrolyte 600.

All of the depicted cosolvents lowered the viscosity of the ionic liquid electrolyte upon mixing. In addition to lowering the viscosity of the ionic liquid electrolyte, some of the cosolvents acted to decrease the conductivity of the ionic liquid electrolyte. This is in contrast to previous observations in which it was assumed that a lower viscosity was linked to an increase in the conductivity of the ionic liquid electrolyte. Instead, it appears that these properties are independent of one another as indicated in both increased and decreased conductivities of the ionic liquid electrolytes containing cosolvents 602-610 as compared to the pure ionic liquid electrolyte 600. As depicted in the graph, conductivities of the ionic liquid electrolyte containing cosolvents relative to the pure ionic liquid electrolyte are increased from approximately 12.5 mS/cm to approximately 30 mS/cm depending on the specific cosolvent.

The ionic liquid electrolyte containing methylene chloride 602 exhibits the greatest increase in conductivity. However, methylene chloride has a lower boiling point of approximately 40° C. Conversely, dichlorobenzenehas higher boiling points, but the ionic liquid based electrolytes containing these cosolvents have lower conductivities. Consequently, of the currently evaluated cosolvents, toluene appears to offer a desirable mix of increased connectivity and a relatively high boiling point of approximately 110° C. However, it should be understood that the current disclosure is not limited to only the use of toluene and the other cosolvents disclosed herein.

Electrodeposition Testing of Additives and Cosolvent Concentrations

Testing was conducted to evaluate the effect of the cosolvents and additive concentrations on dendritic growth suppression and overall electrodeposition quality. Specifically, a set of experiments was conducted to evaluate the effect of hexadecyltrimethylammonium chloride (HDTMAC) and sodium dodecyl sulfate (SDS) in various concentrations, with and without cosolvent, on the resulting electrodeposited metal alloys. The set of experiments included tests conducted with both pure ionic liquid electrolyte and ionic liquid electrolyte containing 50 vol % of toluene. Tests were also conducted for ionic liquid electrolytes without any additives and ionic liquid electrolytes including HDTMAC in low concentrations of 1% and high concentrations of 3% or SDS in low concentrations of 0.1% and high concentrations of 0.2%. Approximately 200 μm thick films were grown on a copper substrate at an electrodeposition rate of ~10-20 μm/hr. The resulting electrodeposited films are shown in FIG. 13.

Figure 13:
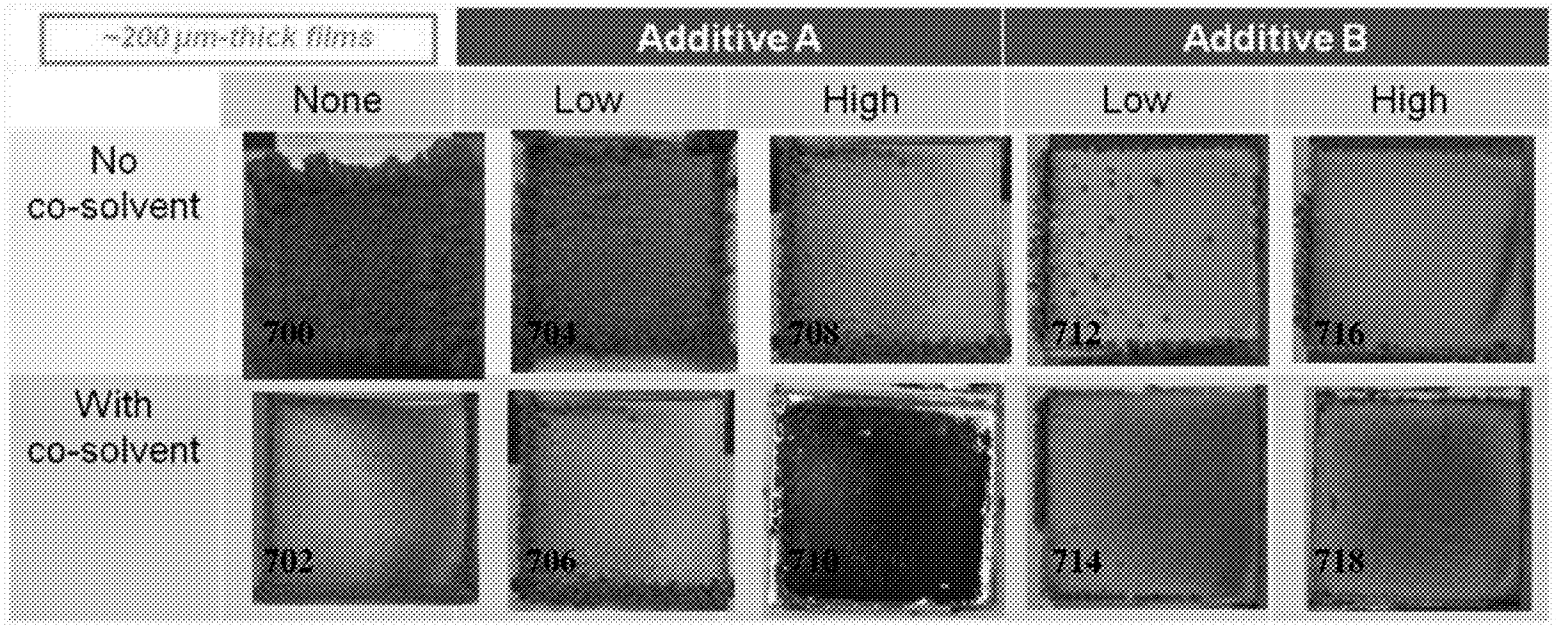
FIG. 13 presents images of electrodeposited surfaces for various concentrations of additives and cosolvents.

As indicated in FIG. 13: electrodeposited film 700 was grown without an additive and without cosolvent; electrodeposited film 702 was grown without an additive and with a cosolvent; electrodeposited film 704 was grown with a low concentration of HDTMAC and without cosolvent; electrodeposited film 706 was grown with a low concentration of HDTMAC and with a cosolvent; electrodeposited film 708 was grown with a high concentration of HDTMAC and without cosolvent; electrodeposited film 710 was grown with a high concentration of HDTMAC and with a cosolvent; electrodeposited film 712 was grown with a low concentration of SDS and without cosolvent; electrodeposited film 714 was grown with a low concentration of SDS and with a cosolvent; electrodeposited film 716 was grown with a high concentration of SDS and without cosolvent; and electrodeposited film 718 was grown with a high concentration of SDS and with a cosolvent.

After electrodeposition, the resulting coupons were evaluated for dendritic growth and resulting surface appearances. As indicated in FIG. 13, the surfaces with the smoothest surface finishes and reduced dendritic growth correspond to ionic liquid based electrolytes containing the high concentrations of HDTMAC or SDS with cosolvent, see 710 and 718.

Ion Concentration in Electrolyte Versus Alloy Concentration

Figure 14:
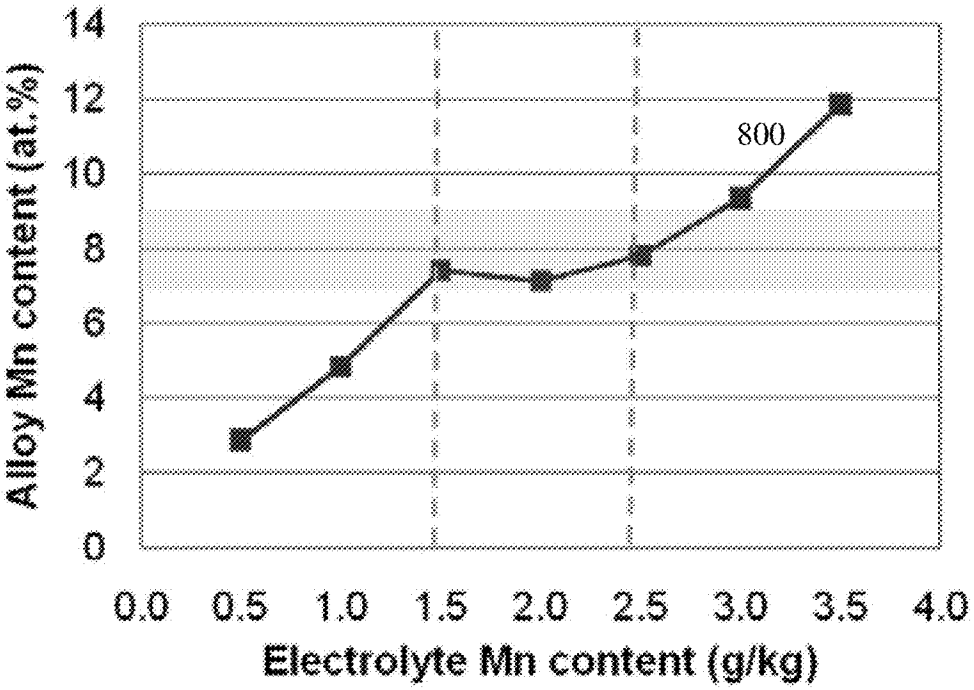
FIG. 14 is a graph of electrolyte manganese concentration versus the manganese concentration of the electrodeposited alloy.

Testing was conducted to identify operating windows for the concentration of manganese ions present within the electrolyte bath for the electrodeposition of specific nano structured aluminum manganese alloy compositions. The results are presented in FIG. 14. While any operating window could be selected for the deposition of any desired alloy composition, in some instances the target aluminum manganese alloy has a composition between approximately 7 at.% percent and 9 at.% manganese. As indicated in the figure, an appropriate manganese content within the ionic liquid electrolyte is between approximately 1.5 g/kg and approximately 2.5 g/kg to provide an electrodeposited aluminum manganese alloy with a composition between approximately 7 at.% percent and 9 at.% manganese. It should be understood that other alloy concentrations and operating windows are also possible.

Electrochemical Evaluation of Flow Sensitivity

Figure 15:
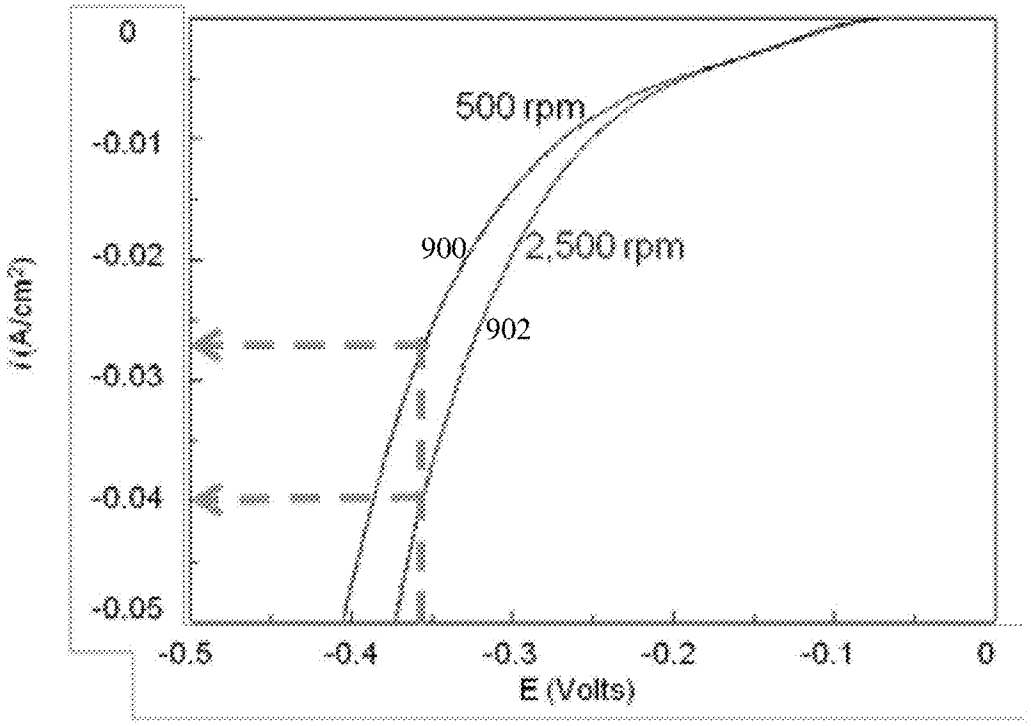
FIG. 15 is a graph of polarization versus current for different flow conditions.

Flow sensitivity of the electrodeposition process influences the ease with which a particular electrodeposition system may be scaled up. Specifically, electrolytes exhibiting high flow sensitivity could result in large thickness distributions across a deposited layer due to nonuniform flow distribution across the deposition surface. In view of the above, a method to evaluate the flow sensitivity of an ionic liquid electrolyte formulation was developed. Specifically, polarization data for the ionic liquid electrolyte formulation was obtained under different flow conditions. An example of this testing method is presented in FIG. 15 where polarization curves are presented for ionic liquid electrolyte comprising 0.1% SDS and were obtained for flow conditions of 500 RPM (900) and 2500 RPM (902) on a standard rotating disk electrode. A large deviation between the various curves along the y-axis is indicative of a high flow sensitivity. It should be understood that the specific flow rate sensitivity will change for different electrochemical systems and different operating parameters. However for the present electrochemical system and operating parameters, a deviation of more than approximately 10% in the current between the 500 RPM and 2500 RPM at the operating voltage of approximately −0.36 V corresponds to a high flow rate sensitivity electrolyte. According to this standard, the depicted electrolyte in FIG. 15 is a high flow rate sensitivity electrolyte. The above described test permits the flow sensitivity of new electrolyte compositions to be quickly and easily evaluated relative to other electrolyte compositions.

High Rate Electrodeposition of a Rod

Figure 16:
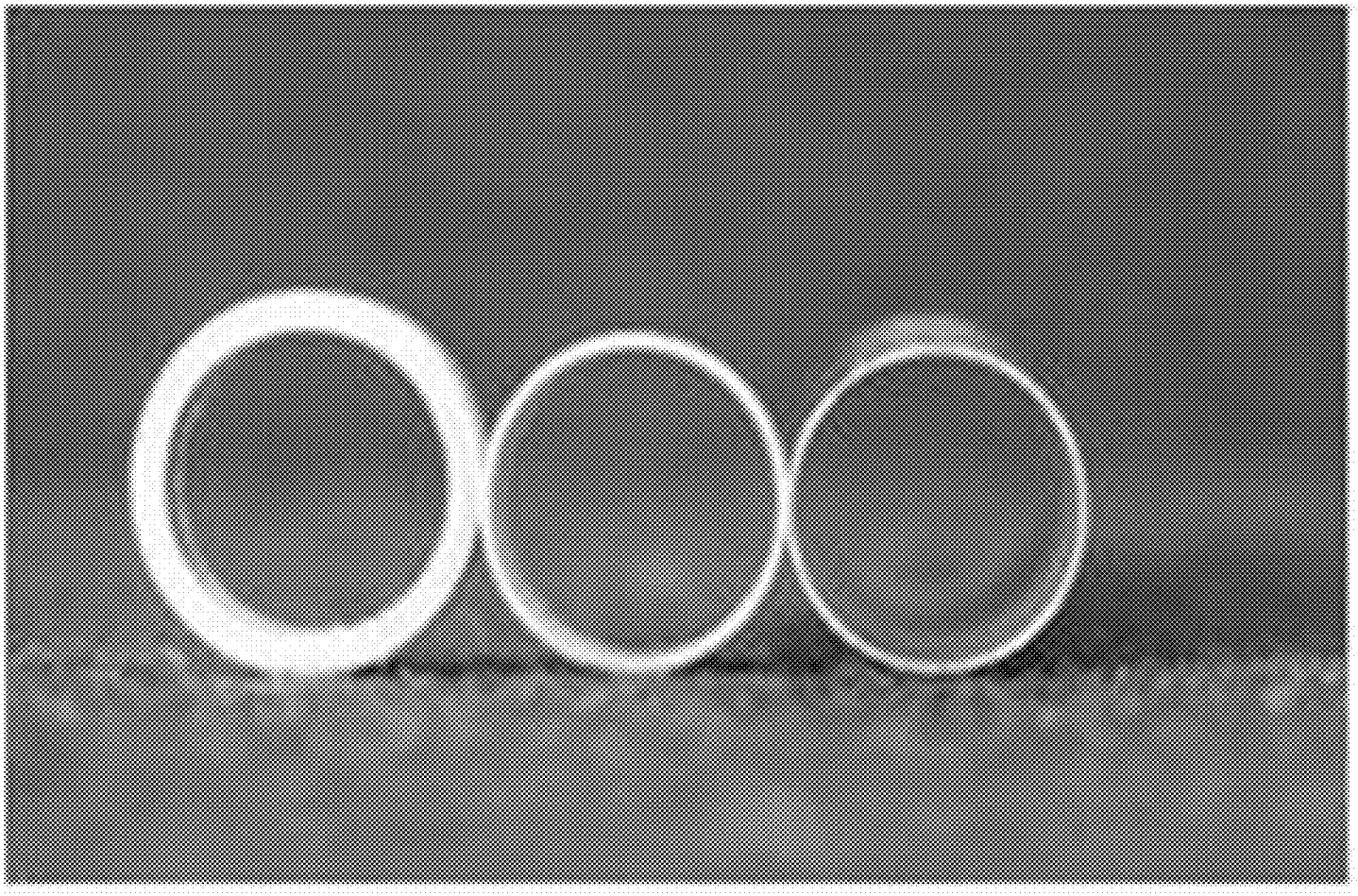
FIG. 16 is a picture of the cross-sections of three electroformed tubes.

FIG. 16 illustrates a cross-sectional image of three free-standing nanostructured aluminum manganese rods with cross-section wall thicknesses of 1.0, 0.3 and 0.1 mm. The ionic liquid electrolyte comprised 3% HDTMAC and 4.5 g of Mn per kg of ionic liquid, and the materials were plated at approximately 11 μm/hr onto rotating mandrels that were subsequently etched to remove. All three rods were electrodeposited without dendrite growth.

Large Area Electrodeposition with Different Flow Configurations

Figure 17B:
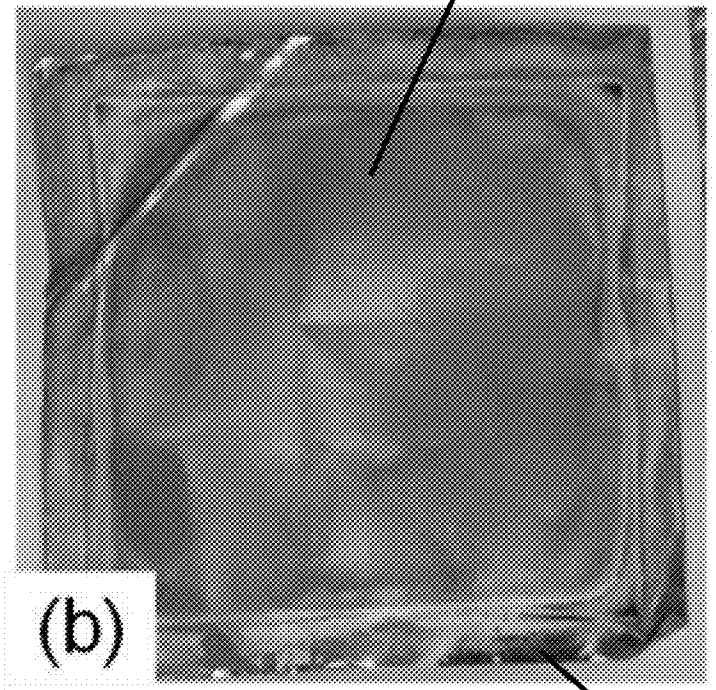
FIG. 17B is a picture of a film plated using a fluid distribution system incorporating a sparger.
Figure 17A:
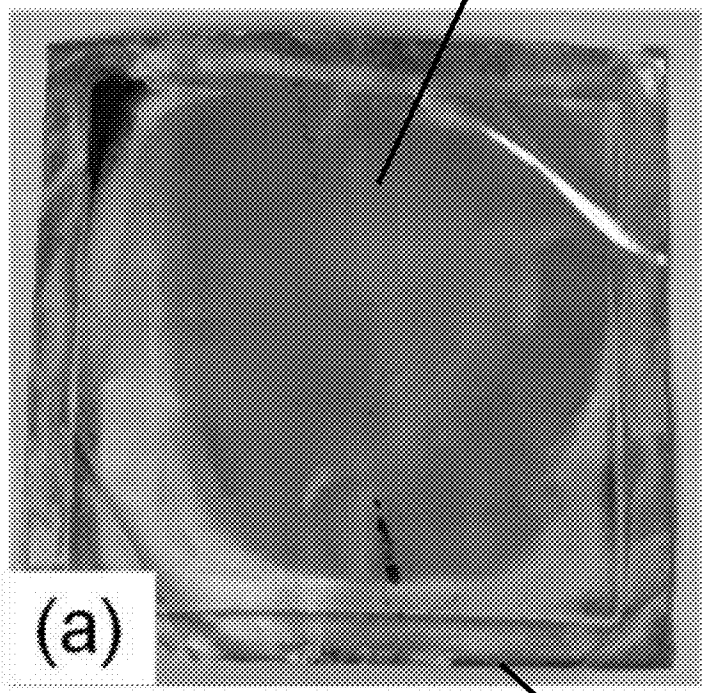
FIG. 17A is a picture of a film electrodeposited using a fluid distribution system incorporating a nozzle.

The effect of different flow distribution systems on the electrodeposition process as it is scaled up was evaluated by plating 10 cm by 10 cm coupons using a nozzle flow arrangement and a sparger flow arrangement, see FIGS. 17A and 17B. The ionic liquid electrolyte comprises 0.2% SDS and 1.5 g of Mn per kg of electrolyte and the material was plated at approximately 15 μm/hr to 20 μm/hr. The resulting test coupons are shown in FIGS. 17A and 17B. The nozzle flow arrangement of FIG. 17A resulted in an electrodeposited layer 1102 deposited on substrate 1100 exhibiting nonuniform layer thickness and composition as indicated by the coloration differences in the image. In contrast, the sparger arrangement of FIG. 17B resulted in an electrodeposited layer 1106 deposited on substrate 1104 exhibiting a more uniform layer thickness and composition distribution as indicated by the uniform coloration in the image. Without wishing to be bound by theory, this is due to the more uniform flow from the sparger arrangement as compared to the nozzle.

Examples of Electrodeposition Rates, Sample Geometries and Properties

Table 2 presents a summary of various electrodeposition rates and sample geometries as well as some of the resulting material properties of the electrodeposited materials. The ductility values were obtained from guided bend test according to ASTM E290-97a.

TABLE 2

| | Specimen properties | | | | |
|---|---|---|---|---|---|
| Plating rate (μm/hr) | Geometry | Lateral dimensions (cm) | Thickness (mm) | Hardness (HV) | Ductility (%) |
| 1.5 | Plate | 2 × 2 | 0.1 | 330 | >20 |
| ~10-15 | Plate | 2 × 2 | 0.04 | 300 | <5 |
| | Plate | 2 × 2 | 0.75 | 300 | <5 |
| | Tube | 1 (dia) × 3 | 1.2 | 260 | — |
| ~15-20 | Plate | 10 × 10 | 0.04 | 310 | >20 |
| | Plate | 10 × 10 | 0.5 | 310 | <5 |
| | Tube | 1 (dia) × 3 | 0.7 | 330 | — |
| ~80 | Circular tab | ~1 (dia) | ~0.02 | —not det. | >16 |
| ~160 | Circular tab | ~1 (dia) | 0.02 | not det. | <11 |

Processing Conditions

To determine appropriate processing parameters for use with electrolyte baths including ionic liquids and the currently disclosed cosolvents, salts, and additives, testing was conducted for the various combinations of polarization waveforms, temperature, and solution agitation. The electrodeposited alloys were plated to a thickness of approximately 100 μm on a rotating copper rod. After the electrodeposition step, the copper substrate was removed by etching in a concentrated nitric acid to obtain a freestanding aluminum alloy tube. Uniaxial tensile tests were then performed on the free-standing tubes. Table 3 summarizes the test results. As evidenced by the test results presented in Table 3, the resulting material properties for the electrodeposited materials is dependent on a variety of parameters. Therefore, it should be understood that a desired material property for the electrodeposited material may be obtained by varying the processing parameters in any number of different combinations and is not limited to varying only a single processing parameter to obtain the desired material property. For example, as illustrated by the preliminary test results shown in Table 3, higher additive content (HDTMAC) slightly decreases tensile strength (compare samples 1 and 2); high temperature apparently decreases the tensile strength in the bath formulation that contains HDTMAC (compare samples 1 and 3) but improves the tensile strength in formulations that contain SDS (compare samples 4 and 5); and that high current densities decreases the tensile strength (compare samples 1 and 6).

TABLE 3

| | | | Pulse parameters | | | | |
|---|---|---|---|---|---|---|---|
| ID | Additive type and levels | Temperature (° C.) | Forward current density ($mA/cm^2$) | Reverse current density ($mA/cm^2$) | Forward pulse duration (ms) | Reverse pulse duration (ms) | Ultimate tensile strength (GPa) |
| 1 | HDTMAC (low) | 35 | 60 | −30 | 20 | 20 | 1.3 |
| 2 | HDTMAC (high) | 35 | 60 | −30 | 20 | 20 | 0.9 |
| 3 | HDTMAC (low) | 60 | 60 | −30 | 20 | 20 | 0.2 |
| 4 | SDS (low) | 60 | 60 | −30 | 20 | 20 | 1.0 |
| 5 | SDS (low) | 35 | 60 | −30 | 20 | 20 | 0.8 |
| 6 | HDTMAC (low) | 35 | 75 | 30 | 20 | 20 | 0.5 |

Tensile Testing

Nanocrystalline aluminum manganese alloys with different alloy Mn contents were deposited onto flat copper substrates in an electrolyte that comprises approximately 2% HDTMAC, approximately 50 vol % toluene at a plating rate of about ~18 μm/hr using the following pulse parameters $i_f$=60 $mA/cm^2$; $i_r$=−30 $mA/cm^2$; $t_f$=$t_r$=20 ms. The resulting materials were machined using a water jet cutter to form dog bone specimens, and the Cu substrate was chemically etched using nitric acid to form free-standing nanocrystalline aluminum manganese dogbones. These free-standing dogbones were subjected to uniaxial tensile testing and the test results are summarized below in Table 4. The results indicate that generally, higher Mn content improves the strength but decreases the ductility.

TABLE 4

| Sample | Alloy composition (at. %-Mn) | $\sigma_y$ (MPa) | UTS (MPa) | $\varepsilon_f$ (%) |
|---|---|---|---|---|
| I | 6.7 | 680 | 870 | 18.9 |
| II | 7.1 | 960 | 1130 | 8.9 |
| III | 7.9 | 1290 | 1350 | 2.7 |

Composite Tensile Testing

Nanocrystalline aluminum manganese alloys with different alloy Mn contents were deposited onto both sides of an aluminum 6061 substrate sheet to form a composite material. The electrolyte comprised approximately 2% HDTMAC, approximately 50 vol % toluene at a plating rate of about 18 μm/hr using the following pulse parameters were used: $i_f$=60 mA/cm$^2$; $i_r$=−30 mA/cm$^2$; $t_f$=$t_r$=20 ms. The resulting composite materials were machined using a water jet cutter to form dog bone specimens and subjected to uniaxial tensile testing. The uniaxial tensile test results for the composite materials and a bare aluminum 6061 point are summarized below in Table 5. The results indicate that by electroplating nanostructured aluminum manganese alloys on both sides of the 6061 substrate, the composite can be made stronger and/or more ductile than the standalone 6061 substrate, and that generally, higher Mn content improves the strength but decreases the ductility.

TABLE 5

| Sample | Alloy composition (at. %-Mn) | $V_f$ nano-Al | $\sigma_y$ (MPa) | UTS (MPa) | $\varepsilon_f$(%) |
|---|---|---|---|---|---|
| 6061 | — | 0 | 310 | 380 | 7.2 |
| A | 7.3 | 0.54 | 460 | 570 | 21.9 |
| B | 7.4 | 0.60 | 500 | 670 | 10.3 |
| C | 8.1 | 0.58 | 540 | 700 | 6.3 |

Additive Concentration

Figure 18:
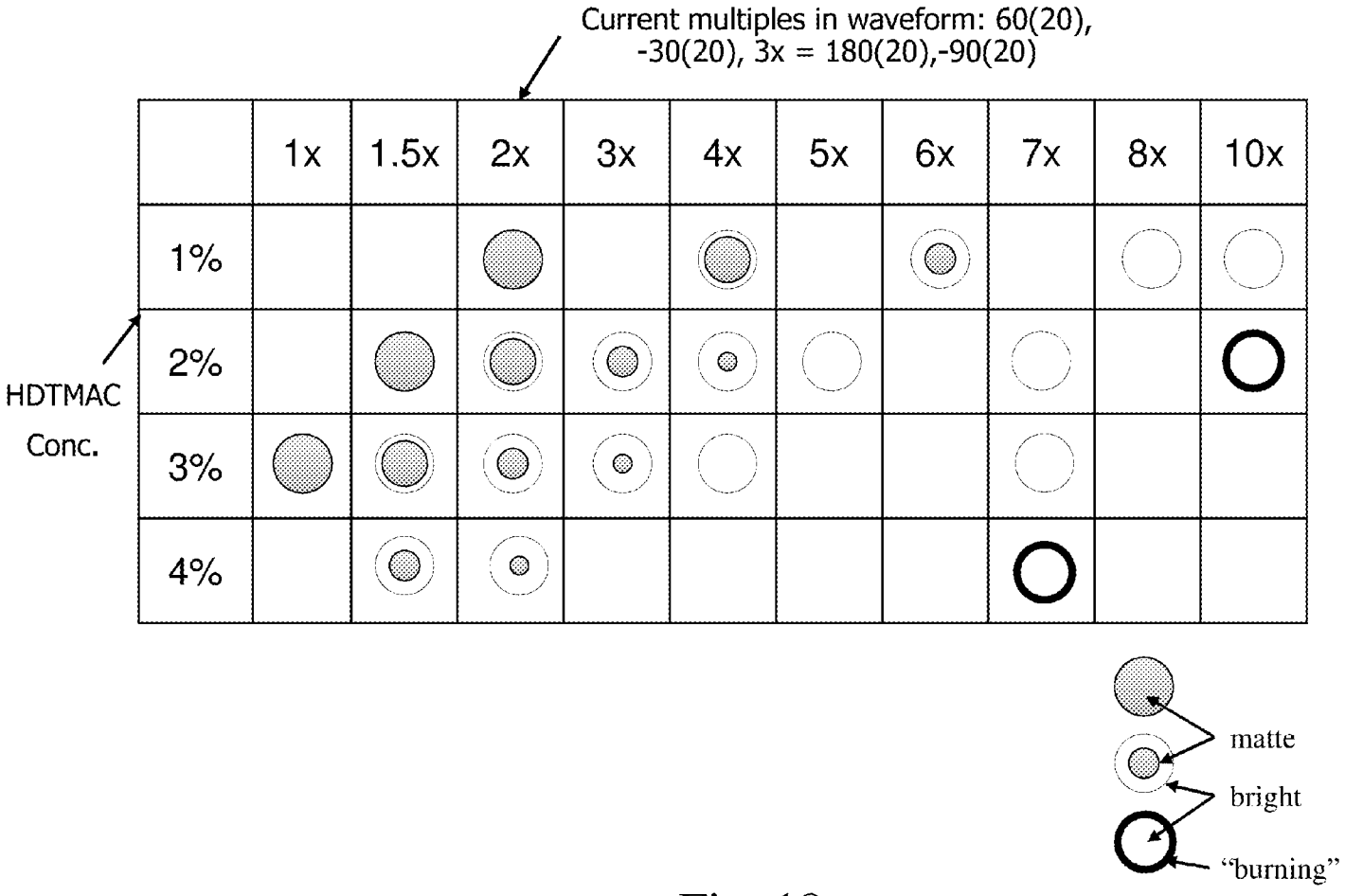
FIG. 18 is a chart comparing the appearance of material deposited from an electrolyte comprising an additive versus the waveform.

The concentration of an additive in an electrodeposition bath was determined as follows. 30 mL solutions were used containing ~1.1 g/kg Mn and 50 vol % toluene and HDTMAC at varying concentrations including 1, 2, 3 and 4%. A rotator that is typically used for common electrochemical experiments using a rotating disc electrode (RDE) was employed wherein films of Al—Mn deposit were plated on a copper foil using Al plate as the anode at 25° C. under controlled flow (rotation of 500 rpm). All films were plated to the same thickness of ~20 μm. The conditions included selected current densities in a reverse pulse waveform, where: forward current=k mA/cm$^2$, forward pulse time=20 ms, reverse current=½ k mA/cm$^2$, reverse pulse time=20 ms, k=60 and multiples of 60 such as 120, 180 . . . ) and the forward and reverse pulse are equal. Based on the concentration of the additive, a chart was formed which depicts the visual appearance of the deposit. The visual appearance depends on the concentration of the additive. See FIG. 18 which shows a chart comparing the appearance of deposited material from an electrolyte comprising as additive versus the waveform. Then, a deposit is plated from a bath comprising an unknown concentration of the additive under substantially similar conditions of waveform and rotation and the appearance of the deposit was compared with the appearances within the chart to determine an approximated concentration of the additive.

Exemplary Waveforms

FIG. 19 presents a summary of testing done to evaluate the effect of the pulse current density and duration on the ductility of the resulting electrodeposited materials. The deposited aluminum manganese alloy samples had compositions ranging from about 7.0 at % Mn to 8.3 at % Mn. The ductility was evaluated using a bending test measurement, and the ductility of each sample was grouped as being greater than, less than, or equal to a ductility of about 12%. Tests A1-A3 were the initial waveforms used with a forward pulse current density double that of the reverse pulse current density and equal forward and reverse pulse durations of 20 ms. Tests A4-A6 used the same current densities as tests A1-A3 with equal pulse durations of 40 ms. Tests A7-A9 used equal current densities for the forward and reverse pulses and a forward pulse duration that was double the reverse pulse duration. Tests A10-A12 were similar to tests A7-A9, but had double the pulse durations. Tests A13-A15 included stronger reverse pulse current densities and increased forward pulse durations. Without wishing to be bound by theory, it appears that shorter pulse times provide better ductility for the currently tested electrodeposited materials. It should be noted that while several samples showed ductilities of less than 12%, the samples still exhibited enhanced properties as compared to samples deposited using direct current deposition methods.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only. Furthermore, various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

What is claimed is:

1. An article comprising:

an electrodeposited aluminum manganese alloy, wherein the electrodeposited aluminum manganese alloy comprises an average grain size less than approximately 1 micrometer, wherein at least a portion of the electrodeposited aluminum manganese alloy has a thickness that is greater than approximately 40 micrometers, wherein a ductility of the entire portion of the electrodeposited aluminum manganese alloy is between approximately 2% and 40%, and wherein the electrodeposited aluminum manganese alloy comprises between approximately 1 atomic percent manganese to approximately 20 atomic percent manganese.

2. The article of claim 1, wherein the thickness of the portion of the electrodeposited aluminum manganese alloy is greater than approximately 50 micrometers.

3. The article as in claim 1, wherein the thickness of the portion of the electrodeposited aluminum manganese alloy is greater than approximately 100 micrometers.

4. The article as in claim 1, wherein the thickness of the portion of the electrodeposited aluminum manganese alloy is greater than approximately 150 micrometers.

5. The article as in claim 1, wherein the thickness of the portion of the electrodeposited aluminum manganese alloy is greater than approximately 200 micrometers.

6. The article as in claim 1, wherein the thickness of the portion of the electrodeposited aluminum manganese alloy is less than approximately 5 millimeters.

7. The article as in claim 1, wherein the thickness of the portion of the electrodeposited aluminum manganese alloy is less than approximately 3 millimeters.

8. The article as in claim 1, wherein the thickness of the portion of the electrodeposited aluminum manganese alloy is less than approximately 1 millimeters.

9. The article as in claim 1, wherein the thickness of the portion of the electrodeposited aluminum manganese alloy is less than approximately 500 micrometers.

10. The article as in claim 1, wherein the electrodeposited aluminum manganese alloy is at least partially amorphous.

11. The article as in claim 1, wherein the electrodeposited aluminum manganese alloy is substantially amorphous.

12. The article as in claim 1, wherein the electrodeposited aluminum manganese alloy comprises between approximately 5 atomic percent manganese to approximately 15 atomic percent manganese.

13. The article as in claim 1, wherein the ductility of the entire portion of the electrodeposited aluminum manganese alloy is greater than approximately 5%.

14. The article as in claim 1, wherein the ductility of the entire portion of the electrodeposited aluminum manganese alloy is greater than approximately 10%.

15. The article as in claim 1, wherein the ductility of the entire portion of the electrodeposited aluminum manganese alloy is less than approximately 15%.

16. The article as in claim 1, wherein the ductility of the entire portion of the electrodeposited aluminum manganese alloy is less than approximately 20%.

17. The article as in claim 1 further comprising a substrate, wherein the electrodeposited aluminum manganese alloy is disposed on the substrate.

18. The article as in claim 17 wherein the substrate and the electrodeposited aluminum manganese alloy form a composite.

19. The article as in claim 18 wherein the composite is a layered composite.

20. The article as in claim 18 wherein a proportion by weight of the electrodeposited aluminum manganese alloy in the composite is less than a proportion by weight of the substrate in the composite.

21. The article as in claim 17 wherein the electrodeposited aluminum manganese alloy substantially encapsulates the substrate.

22. The article as in claim 1, wherein the ductility of the entire portion of the electrodeposited aluminum manganese alloy is between approximately 5% and 25%.

23. The article as in claim 22, wherein the thickness of the portion of the electrodeposited aluminum manganese alloy is less than approximately 300 micrometers.

24. The article as in claim 22, wherein the electrodeposited aluminum manganese alloy comprises between approximately 6 atomic percent manganese to approximately 12 atomic percent manganese.

* * * * *